US007322911B2

(12) United States Patent
Webber

(10) Patent No.: US 7,322,911 B2
(45) Date of Patent: Jan. 29, 2008

(54) EXERCISE BENCH

(76) Inventor: Randall T. Webber, 1265 Park Row, La Jolla, CA (US) 92037

( * ) Notice: Subject to any disclaimer, the term of this patent is extended or adjusted under 35 U.S.C. 154(b) by 0 days.

(21) Appl. No.: 11/249,987

(22) Filed: Oct. 12, 2005

(65) Prior Publication Data

US 2006/0217249 A1 Sep. 28, 2006

Related U.S. Application Data

(60) Provisional application No. 60/664,454, filed on Mar. 22, 2005.

(51) Int. Cl.
*A63B 26/00* (2006.01)

(52) U.S. Cl. ..... 482/142; 482/142

(58) Field of Classification Search ..... 482/142
See application file for complete search history.

(56) References Cited

U.S. PATENT DOCUMENTS

| | | | | |
|---|---|---|---|---|
| 4,623,144 | A | 11/1986 | Rockwell | |
| 4,627,619 | A | 12/1986 | Rockwell et al. | |
| 5,190,513 | A | 3/1993 | Habing et al. | |
| D370,506 | S * | 6/1996 | Clem | D21/687 |
| 5,971,902 | A * | 10/1999 | Robertson et al. | 482/142 |
| 5,997,450 | A * | 12/1999 | Wilkinson | 482/142 |
| 6,001,051 | A * | 12/1999 | Chuan-Pin | 482/131 |
| 6,206,809 | B1 | 3/2001 | Habing et al. | |
| 6,231,489 | B1 * | 5/2001 | McBride et al. | 482/142 |
| 6,248,047 | B1 | 6/2001 | Abdo | |
| 6,258,016 | B1 | 7/2001 | Kuo | |
| 6,287,244 | B1 | 9/2001 | Boos | |
| 6,379,289 | B1 | 4/2002 | Gossie | |
| 6,387,024 | B1 | 5/2002 | Monti et al. | |
| 6,478,721 | B1 | 11/2002 | Hunter | |
| 6,491,607 | B2 | 12/2002 | Simmons et al. | |
| 6,575,884 | B1 | 6/2003 | Eazor | |
| D477,372 | S * | 7/2003 | Garner | D21/690 |
| 6,740,015 | B1 | 5/2004 | Stearns | |

OTHER PUBLICATIONS

Sit-up Bench, Speedent Corp. brochure, 1997.
Kamparts EZ-Life brochure, date unknown.
Zheigang Machinery & Equipment Corporation brochure, Abdominal Benches, ZE32020-12; -13; -14 and ZE32020-16, date unknown.

(Continued)

*Primary Examiner*—Lori Amerson
(74) *Attorney, Agent, or Firm*—Procopio, Cory, Hargreaves & Savitch LLP

(57) ABSTRACT

An exercise bench has a main support frame with a floor engaging member at one end and a folding front leg assembly at the other end which can be locked in a deployed position or a folded position. A user engaging foot stabilizer is pivotally associated with the front leg, and a thigh support is adjustably mounted on the front leg assembly or main support frame for engaging the thighs of a user when performing exercises while supported on the bench. The thigh support may be separate from or form part of a seat pad mounted on the frame. The bench is adjustable between positions for performing abdominal crunch or lower back exercises and is adjustable in both positions to allow different users to perform exercises effectively.

24 Claims, 36 Drawing Sheets

OTHER PUBLICATIONS

Hoist Fitness Brochure 2000 CF2162 Super Adjustable Decline Bench.

Kays Fitness Brochure, 2003, Various abdominal and low back exercise benches.

Nautilus Fitness Brochure, 2001, Various abdominal and low back benches.

KW 105m Abdominal bench, Galaxy Star brochure, date unknown.

* cited by examiner

FIG. 34A
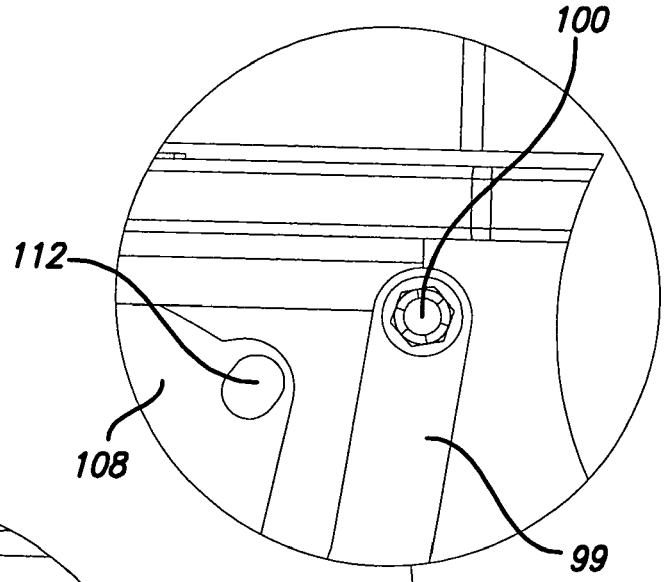
FIG. 34B
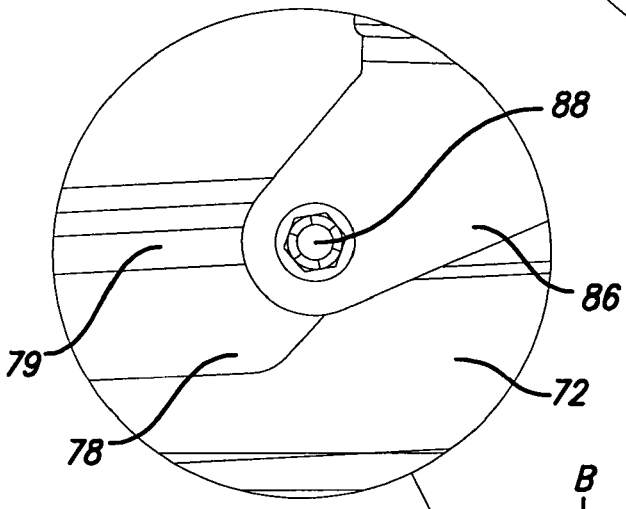
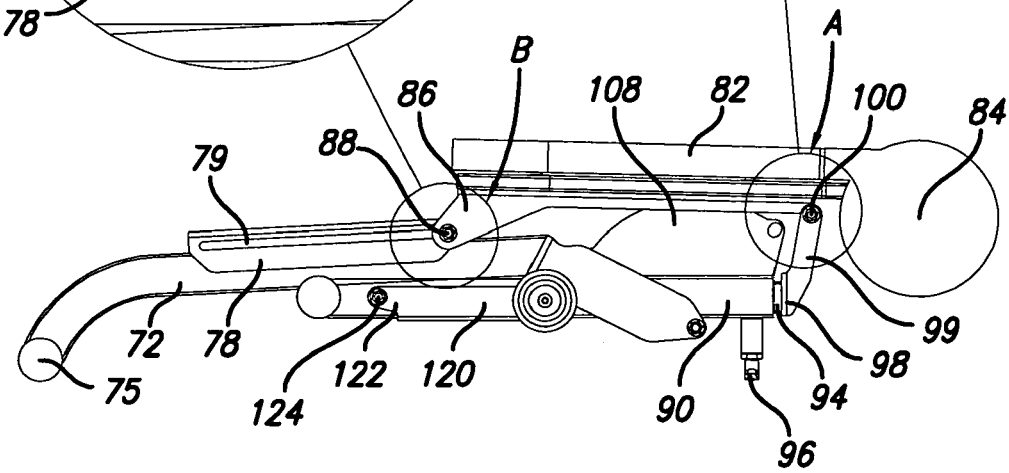
FIG. 34

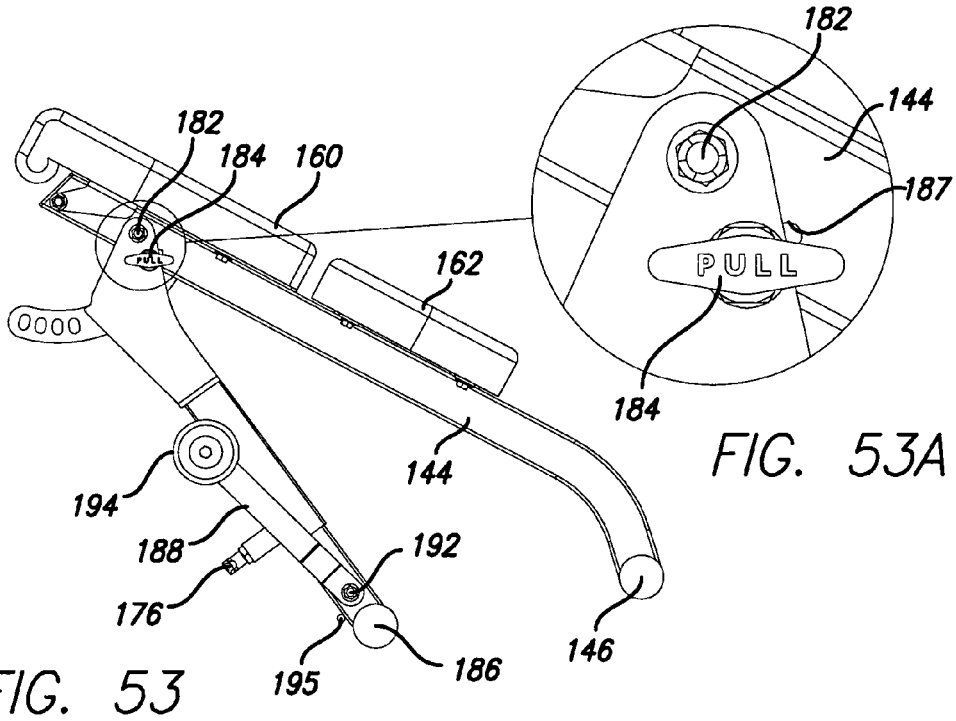
FIG. 53
FIG. 53A
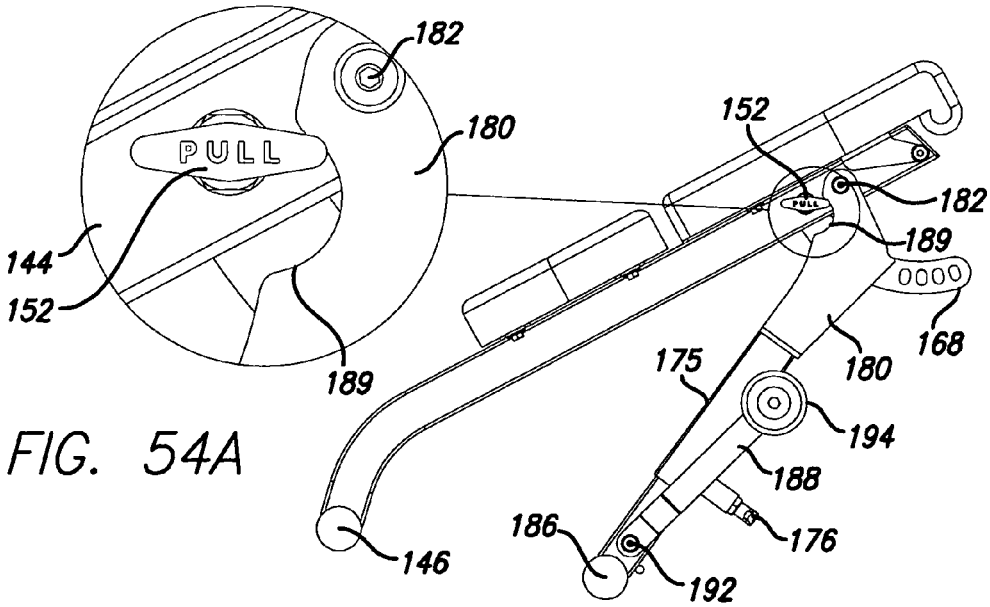
FIG. 54A
FIG. 54

EXERCISE BENCH

CROSS REFERENCE TO RELATED APPLICATIONS

This application claims the benefit of priority of U.S. provisional application Ser. No. 60/664,454, filed Mar. 22, 2005, which is incorporated herein by reference in its entirety.

BACKGROUND OF THE INVENTION

The present invention relates to exercise benches for supporting a user while performing exercise, and is particularly concerned with an exercise bench for performing both abdominal and low back exercises.

Exercise benches designed for performing abdominal or sit up exercises as well as lower back exercises such as hyper-extensions are known in the field. A simple inclined bench may be used to perform sit up exercises. Devices for performing hyper-extensions typically support the user leaning forwardly against a thigh support pad engaging the front of the user's thighs with their feet held in place by foot and ankle pads. The user then bends their upper body forward and downward at the waist, and then bends back up and rearward into alignment with the lower half of their body. This exercises the user's lower back muscles.

Some exercise benches are adaptable for both abdominal and lower back exercises. For example, U.S. Pat. No. 5,190,513 of Habing et al. describes a dual station exercise bench having a generally A shaped frame, with a back pad pivotally secured to one leg of the frame, and a secondary tube welded to the front face of the second leg of the frame and housing an adjustable slide member with thigh support pads mounted on its upper end. A second set of roller pads are pivotally mounted on the adjustable slide member below the thigh pads, for engaging a user's ankles when performing sit up or abdominal crunch exercises. A third set of roller pads are located at the lower end of the second leg, along with angled foot pads. The user stands on the foot pads with the third roller pads engaging behind their ankles while performing lower back exercises. This exercise bench has a large number of parts and is relatively heavy. It is also not foldable for storage or shipping.

Some exercise benches which can be used for lower back or abdominal exercises can be folded, but generally require removal of some parts to allow folding of the remainder of the bench. For example, U.S. Pat. No. 6,206,809 of Habing requires removal of an actuator arm carrying the thigh pad before it can be folded. U.S. Pat. No. 6,258,016 of Kuo requires the seat to be removed prior to folding the remainder of the frame. This makes movement of the bench between the folded and deployed positions inconvenient and does not allow for safe storage of the separated component.

SUMMARY OF THE INVENTION

It is an object of the present invention to provide a new and improved exercise bench for performing abdominal and lower back exercises.

According to one aspect of the present invention, an exercise bench is provided which comprises a frame assembly having a first frame portion having floor engaging end and a second end, at least a forward part of the first frame portion being inclined upwardly towards the second end of the frame in an exercise position of the bench, and a second frame portion comprising a front leg secured to the first frame portion and having a foot portion for engaging the ground, a user engaging foot stabilizer pivotally associated with the front leg, and a thigh support adjustably mounted on the frame assembly for engaging the thighs of a user when performing exercises while supported on the bench, whereby the spacing between the user engaging foot stabilizer and the thigh support is adjustable.

The thigh support, which provides support for the user's upper thigh during a back hyper-extension exercise, may be associated with either the first frame portion or main support frame, or with the second frame portion or front support leg. The adjustable spacing between the thigh support or thigh pad and the foot stabilizer allows for adjustment of the bench for users of different heights and also for different body orientations. The exercise bench may be designed for performing only abdominal exercises or for only lower back exercises, but in the exemplary embodiment it is a combination bench which can be used for both abdominal and lower back exercises. When performing an abdominal exercise, the user will sit on a seat pad located on a downwardly inclined part of the first frame portion facing forward, and hook their feet under the self-aligning foot stabilizer with the back of their lower thighs resting on the thigh support. They then bend rearward, pivoting at the waist to put their abdominal muscles under tension, and subsequently pivot back up into a sitting position. In order to perform a lower back exercise, the thigh support is adjusted to contact the upper thigh region of the user, and the user then stands facing the rear of the bench with their feet on the foot portion of the front leg and the foot stabilizer engaging behind their ankles, with their body in a forward lean so their upper thighs engage the thigh support. They then bend forward at the waist until their lower back muscles are under tension, subsequently returning to the start position.

In an exemplary embodiment of the invention, the user engaging foot stabilizer is pivotally mounted on the front leg so as to extend in front of the leg, and a stop device is provided for limiting the pivotal range of motion of the foot stabilizer in at least one direction. The stop device may be designed to prevent the foot stabilizer from pivoting to a position in which it is at a lower elevation than the pivot connection point to the front leg. This will keep the foot stabilizer within range of a user's feet when positioning themselves for either a seated abdominal exercise or a standing low back exercise. The foot stabilizer is designed to keep the user secured and properly positioned when performing exercises. It is designed to rest on top of the user's feet during an abdominal crunch exercise, keeping their feet securely on the bench by preventing the feet from sliding forward and preventing them from tipping over when they lean rearward. The foot stabilizer rests above the user's heels during a back hyper-extension exercise, keeping their feet securely on the bench by preventing them from sliding rearward.

The front leg may be pivotally secured to the second end of the first frame portion so that it can be folded up for storage, and may be tucked up within the framework of the first frame portion when folded to provide a compact storage position. The foot stabilizer may be foldable into a storage position in which at least part of the foot stabilizer swings past the front wall of the front leg to provide a more compact folded profile, and also keeps the foot stabilizer, which may comprise foot engaging roller pads, protected within the framework of the support frame. The front leg may be lockable in both the folded storage position against the underside of the first frame portion and the deployed or exercise position in which it is inclined forwardly from the first frame portion. The foot portion or cross member at the lower end of the front leg also acts as a foot support or rest for the user to stand on when they are exercising their lower back muscles. This allows the user's weight to bear down on the floor engaging member or support in order to prevent the bench from tipping or sliding as the user performs lower back exercises.

The exercise bench of this invention can be folded into a storage position without first having to remove any component of the bench. Exercises performed on the bench are gravity resisted and un-assisted by any supplemental weights or exercise resistance, although supplemental weights or exercise resistance may be added if desired.

In an exemplary embodiment of the invention, the front leg has a first tube and an adjuster member or tube telescopically associated with the first tube and releasably lockable in a series of different extended positions relative to the first tube. In one embodiment, the first tube has an upper end secured to the forward end of the first frame portion and the adjuster member is slidably mounted in an upper end of the first tube with the thigh support secured to the upper end of the adjuster member. The thigh support may be a pair of thigh pads or rollers projecting in opposite directions from the upper end of the adjuster member. In an alternative arrangement, the thigh support is an enlarged portion of a forward end of a seat pad which has a rear end pivotally associated with the first frame portion, so that extension of the adjuster member will increase the angle of the seat pad while also raising the height of the thigh support.

In another embodiment of the invention, a pad pivotally associated with a forward part of the first frame portion can be secured in a first or down position seated on the first frame portion to act as a seat pad for a user performing abdominal exercises, or in a second, raised position to act as a thigh support for a user performing lower back exercises. The angle of the pad in the raised position can also be varied to adjust exercise difficulty. In this embodiment, the upper end of the adjuster member is secured to the forward end of the first frame portion, so that adjustment of the extension of the adjuster member will also adjust the height of the pad in the second, raised position and the inclination of the pad when acting as a seat in the down position.

According to another aspect of the present invention, a combination bench for exercising the abdominals and low back of a user is provided, the bench having a main frame and a folding assembly that can fold up for storage without the removal of any component or fastener. The bench can be locked in both the exercise and storage position, with the folding assembly tucked up within the frame work of the non-folding or main frame part in the storage position. A user engaging foot stabilizer is pivotally attached to the folding assembly with an arrangement that allows at least a portion of the user engaging section of the foot stabilizer to swing past the front wall or edge of the folding assembly in the folded or storage position, producing a more compact storage condition.

In another embodiment of the invention, a combination bench for exercising the abdominals and low back of a user is provided, the bench having a frame and a foot stabilizing device pivotally attached to the frame for providing stabilization and proper positioning of the user's feet during both exercises, the foot stabilizing device pivoting so as to self-align to the feet of the user in each exercise position, and having a limit or stop member to restrict its range of motion in at least one direction. The foot stabilizing device may comprise a cross member extending transversely across a front portion of the frame, oppositely directed pads secured to opposite ends of the cross member, and a pivot bracket assembly pivotally securing the cross member to the frame. The cross member engages the front portion of the frame to restrict pivoting motion of the foot stabilizing device in a first direction. A stop member may be mounted on the frame to restrict pivoting motion in a second direction such that the foot stabilizer can always be reached readily by the user's feet.

A bench for exercising the low back of a user according to another aspect of the invention has a main frame and a folding assembly that can fold up for storage without the removal of any component or fastener, the folding assembly being lockable in at least one of an exercise position and a storage position, and tucking up within the frame in the storage position. The folding assembly has a user engaging foot stabilizer, pivotally associated with the folding assembly in a manner that allows at least a portion of the user engaging section of said foot stabilizer to swing past the front wall or edge of said folding assembly in the storage position to allow for a more compact storage condition.

According to another aspect of the present invention, an exercise bench is provided which comprises a main frame having a first end for engaging the ground and a second end raised above the ground in an exercise position, and a front leg secured to the main frame and having a foot portion for engaging the ground in the exercise position to hold the second end of the main frame in the raised position, a support pad for supporting part of the user's body being mounted on either the front leg or the main frame, the front leg being adjustable in length to adjust the height of the support pad, and a user engaging foot stabilizer pivotally associated with the front leg with the pivot mounting at a fixed position relative to the foot portion, whereby adjustment of the length of the front leg adjusts the distance between the foot stabilizer pivot mounting and the support pad so as to accommodate user's having different length legs.

In an exemplary embodiment of the invention, a seat pad has a forward end secured to an upper end of the front leg and a rear end pivotally associated with a member slidably mounted on the main frame, whereby adjustment of the length of the front leg will cause the forward end of the seat pad to pivot upwardly and the rear end to slide forwardly along the main frame.

The exercise bench of this invention allows a user to perform either abdominal or lower back exercises, and has a folding front leg assembly so that it can fold up flat for easier storage The bench is readily adjustable to allow various size exercisers to perform both exercises effectively, and also to adjust the exercise difficulty. A thigh pad of adjustable height is provided either on the main frame or front leg assembly, and self-aligning, ankle engaging foot stabilizer pads are pivotally mounted on a part of the front leg assembly, so that the thigh pad can be adjusted independent of the ankle engaging pads.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which:

FIG. 34 is a side elevation view similar to FIG. 32 illustrating the bench in the folded position;

FIG. 34A is an expanded view of the circled region A of FIG. 34;

FIG. 34B is an expanded view of the circled region B of FIG. 34;

FIG. 53 is a side elevation view of the bench of FIGS. 37 to 52 illustrating the front leg assembly being folded about its pivotal connection to the main frame towards the folded position;

FIG. 53A is an expanded view of the circled region of FIG. 53 illustrating the locking pin and pinning hole for locking the folded leg assembly in the folded position;

FIG. 54 is a side elevation view similar to FIG. 53 but from the opposite direction to FIG. 53;

FIG. 54A is an expanded view of the circled region of FIG. 54 illustrating the notch in the leg assembly bracket for fitting around the seat pad adjusting pull pin;

DETAILED DESCRIPTION OF THE DRAWINGS

Figure 1:
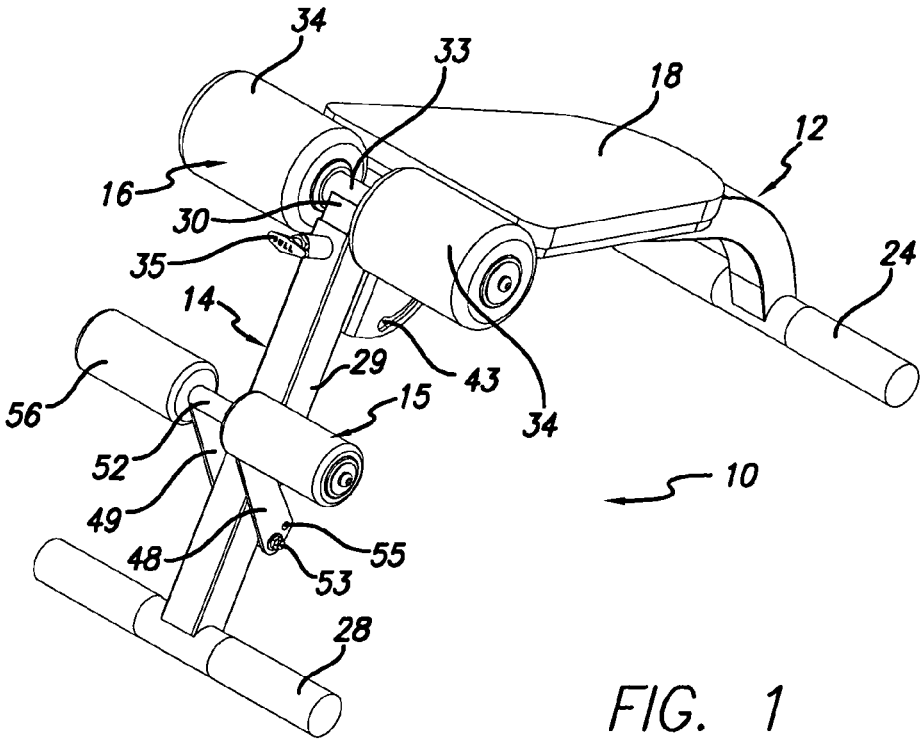
FIG. 1 is a perspective view of an exercise bench according to a first embodiment of the invention, with the bench configured for performing abdominal crunch exercises.
Figure 2:
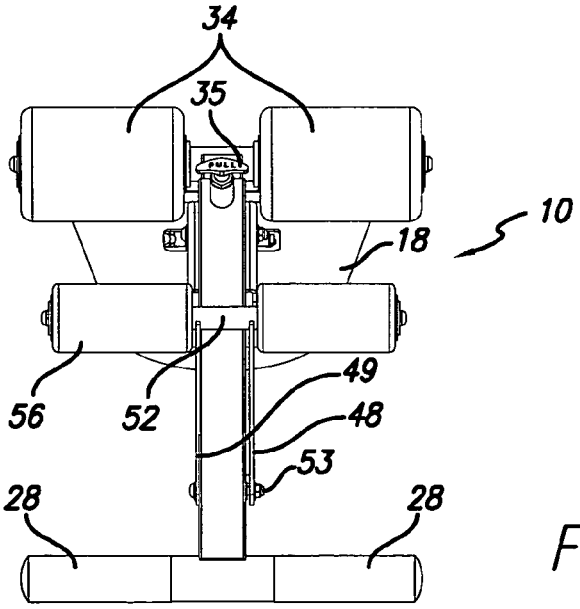
FIG. 2 is a front view of the bench of FIG. 1.

FIGS. 1 to 18 illustrate a foldable exercise bench 10 according to a first embodiment of the invention for performing abdominal crunch exercises or lower back exercises. The bench consists of 5 main elements: A main support frame 12, a folding front leg assembly 14, a foot stabilizer 15, a thigh support 16 and a seat pad 18, as indicated in FIG. 1.

FIGS. 1 to 5 illustrate the bench 10 in a first exercise position for performing abdominal crunch exercises, while FIGS. 6 to 10 illustrate the bench 10 in a second exercise position for performing back hyper-extension exercises. FIGS. 11 to 14 illustrate the bench in a folded or storage position, and FIGS. 15 to 18 illustrate various details of the bench components.

Figure 3:
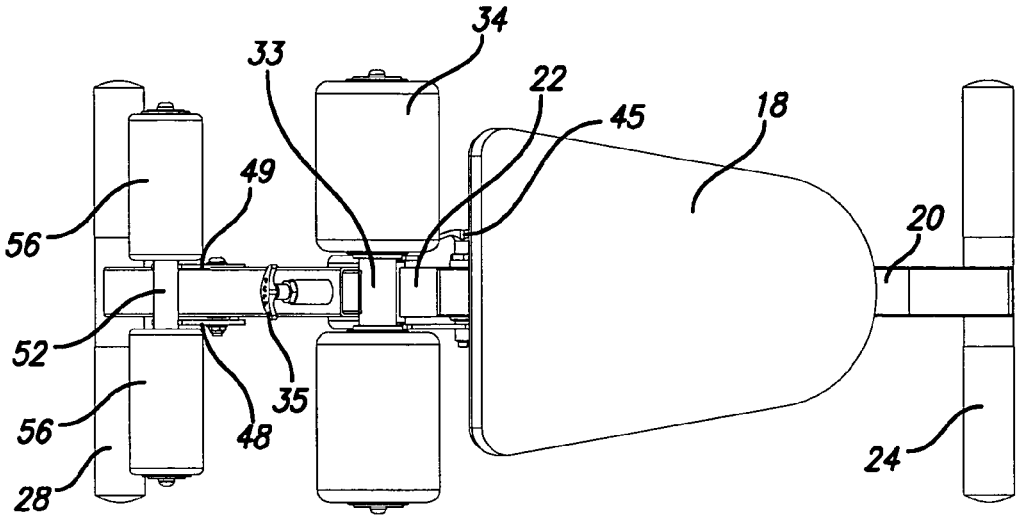
FIG. 3 is a top plan view of the bench of FIG. 1.

The main support frame 12 comprises a main tube 20 which has a floor engaging cross support 24 connected at a first end and a support plate 22 (FIGS. 3 and 4) connected to a second end. The main tube angles downward and rearward from its second end and has a downward bend 25 approximate its first end. The seat pad 18 is engaged with the main tube 20 with a forward end of the seat pad adjacent the second end of the tube. The seat pad is tapered, as best seen in FIG. 3, with the widest end at the front closest to the second end of the main tube.

The folding front leg assembly 14 is pivotally connected to the main support frame by pivot pin 26 located adjacent its upper end and has a floor engaging cross support 28 associated with its second or lower end. The front leg assembly holds the main tube 20 in the raised position when in the deployed, exercise positions of FIGS. 1 to 10, as best illustrated in FIGS. 1, 4, 6 and 9. The lower cross support 28 also acts as a foot rest or support for the user to stand on when they are performing back exercises. This allows the user's weight to bear down on the floor engaging section to prevent the bench from tipping or sliding as the user is exercising their low back muscles.

The folding front leg assembly comprises a tubular front support leg 29 with an open upper end and the floor engaging cross support 28 is transversely attached at the lower end. An adjuster tube 30 with multiple adjustment openings 32 (see FIGS. 6 and 7) is inserted into the open first end of the front support leg for telescopic adjustment with the support leg. One end of the adjuster tube protrudes past the open end of the support leg and has a round pad support rod 33 transversely mounted at its upper end. Roller pads 34 are mounted over the ends of the pad support rod 33. The roller pads 34 comprise the thigh support 16 for engaging the user's thighs when the adjuster tube is elevated for low back exercises, as in FIGS. 6 to 10. The pads 34 also provide support behind a seated user's knees during abdominal exercises. A pull pin 35 extends through the front wall of the front support leg 29 adjacent its open upper end and into a selected aligned opening 32 in the adjuster tube so as to lock the adjustment tube at a selected extension.

Figure 4:
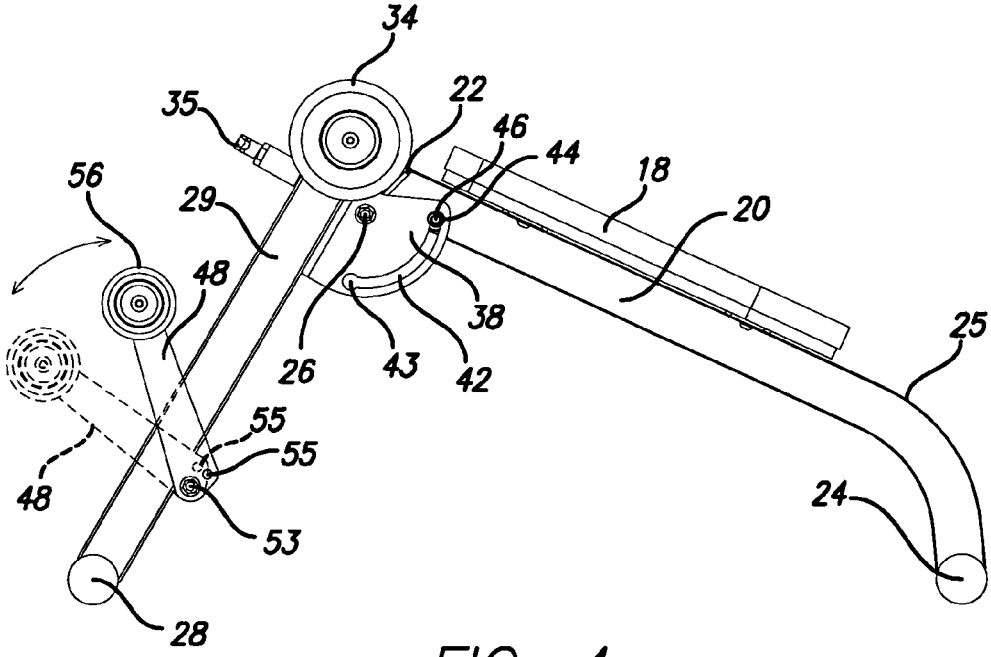
FIG. 4 is a side view of the bench of FIG. 1.
Figure 5:
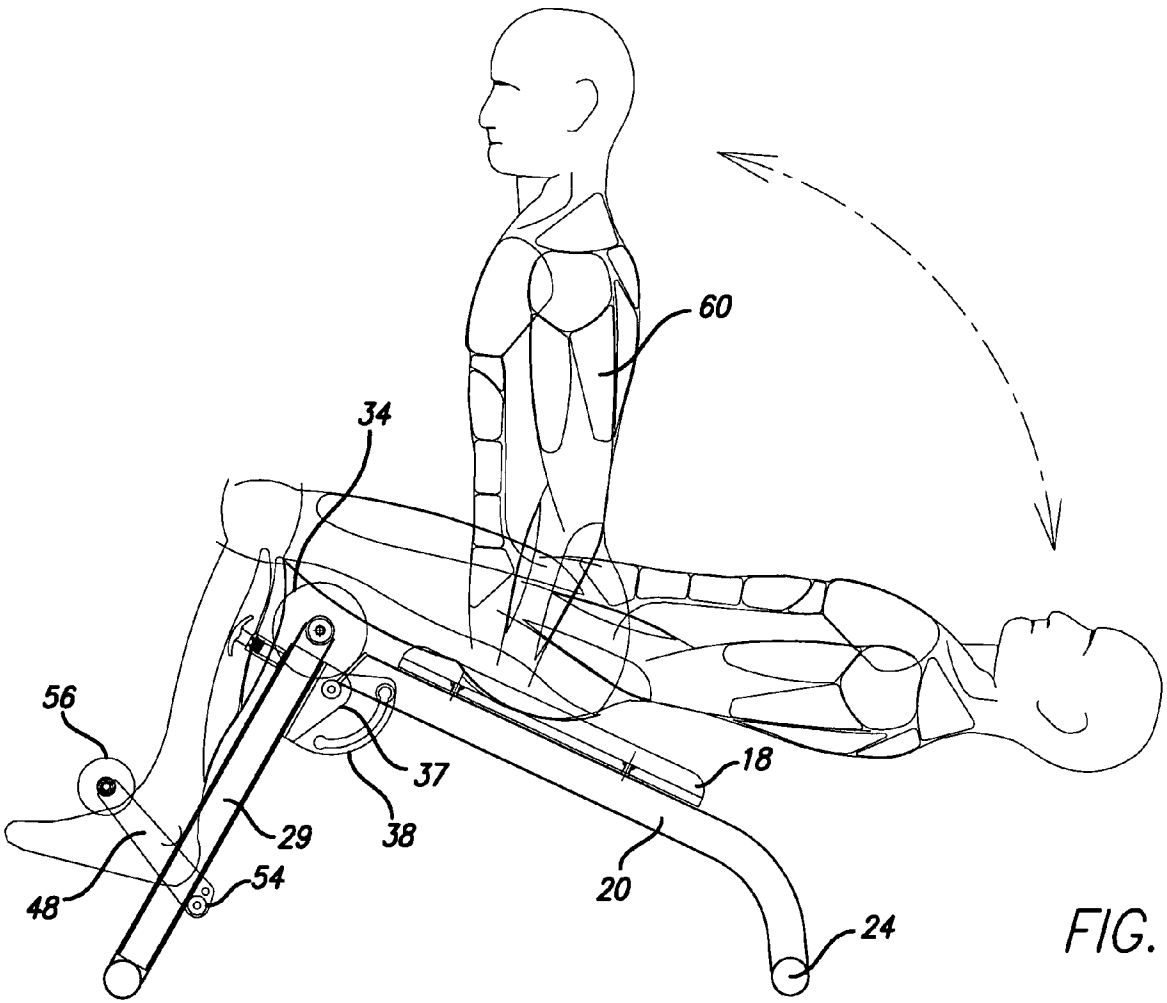
FIG. 5 is a side elevation view of the bench similar to FIG. 4, illustrating a user performing a seated abdominal exercise.
Figure 6:
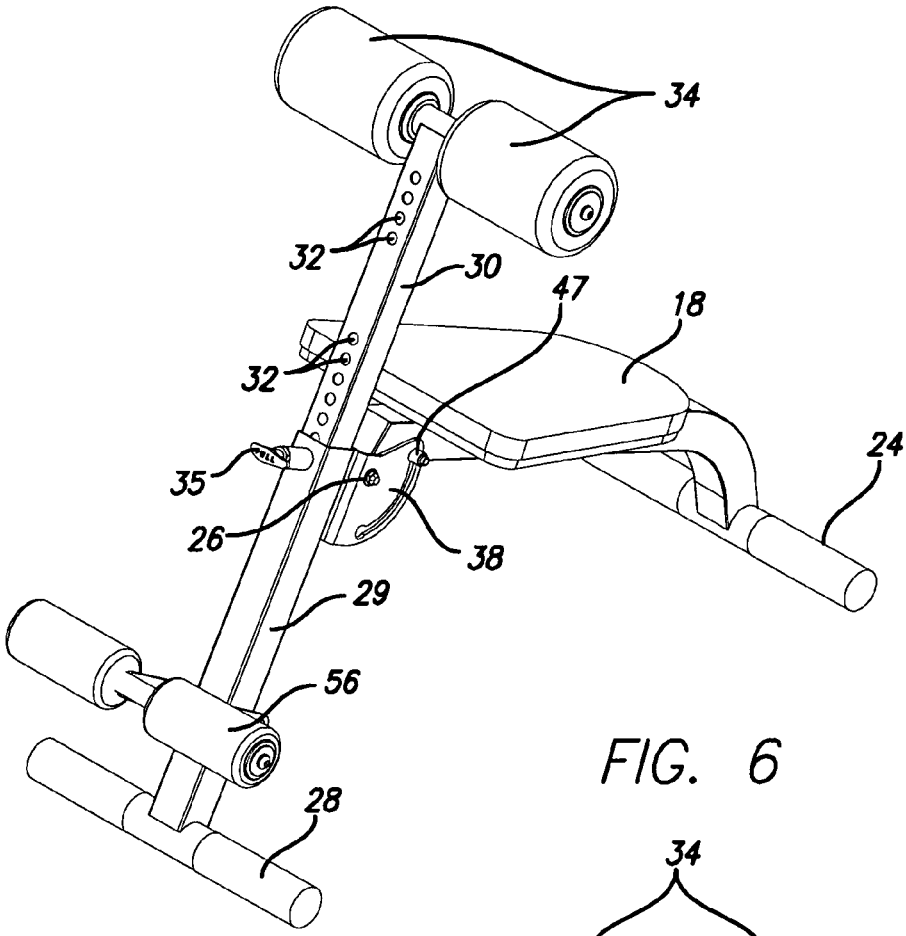
FIG. 6 is a perspective view similar to FIG. 1 but illustrating the bench configured for performing a back hyper-extension exercise.
Figure 7:
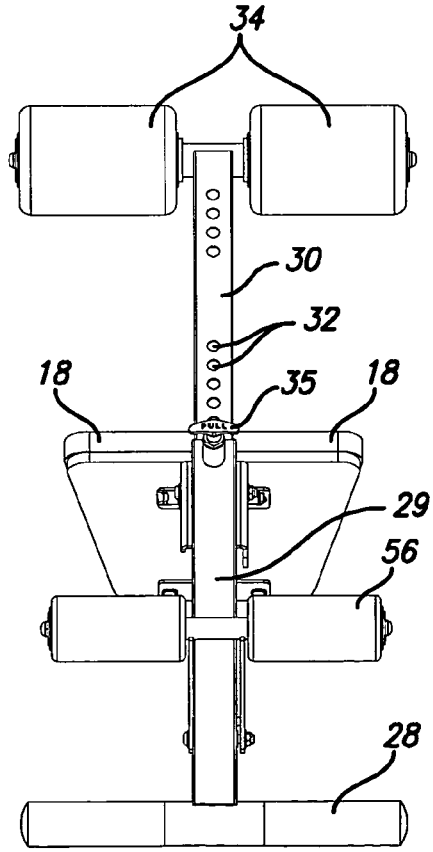
FIG. 7 is front view of the bench in the configuration of FIG. 6.
Figure 8:
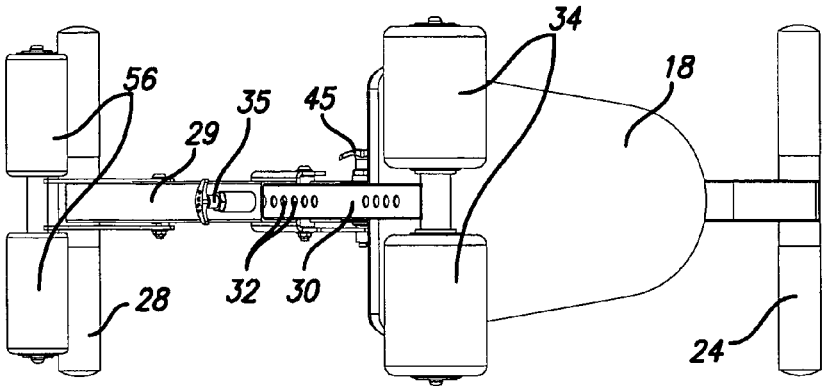
FIG. 8 is a top plan view of the bench configured as in FIG. 6 for lower back exercises.
Figure 9:
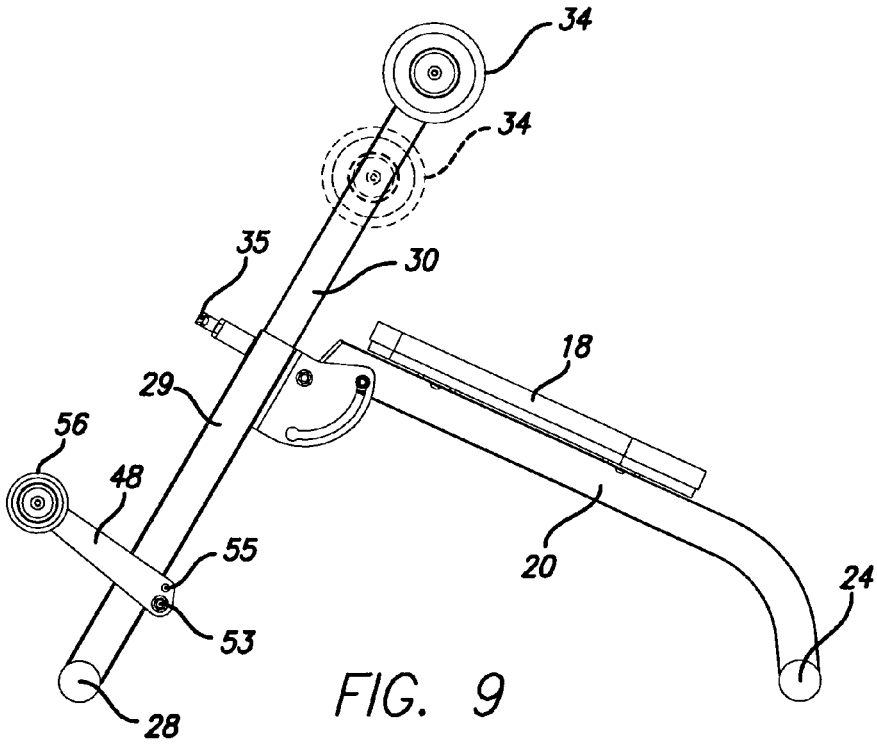
FIG. 9 is a side elevation view of the bench in the back exercise configuration of FIGS. 6 to 8.
Figure 11:
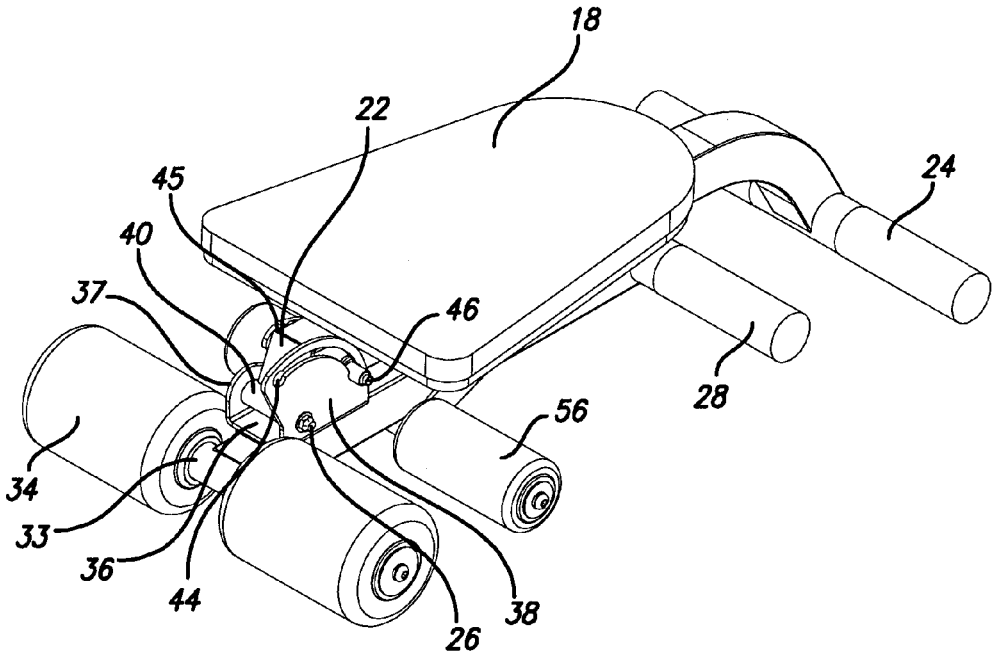
FIG. 11 is a perspective view of the bench of FIGS. 1 to 10 in a folded, storage position.
Figure 12:
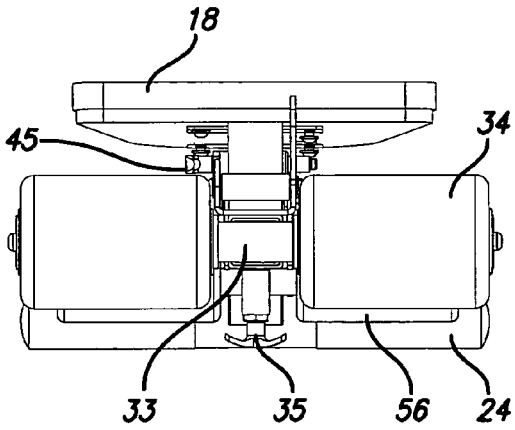
FIG. 12 is a front view of the bench in the storage position.
Figure 13:
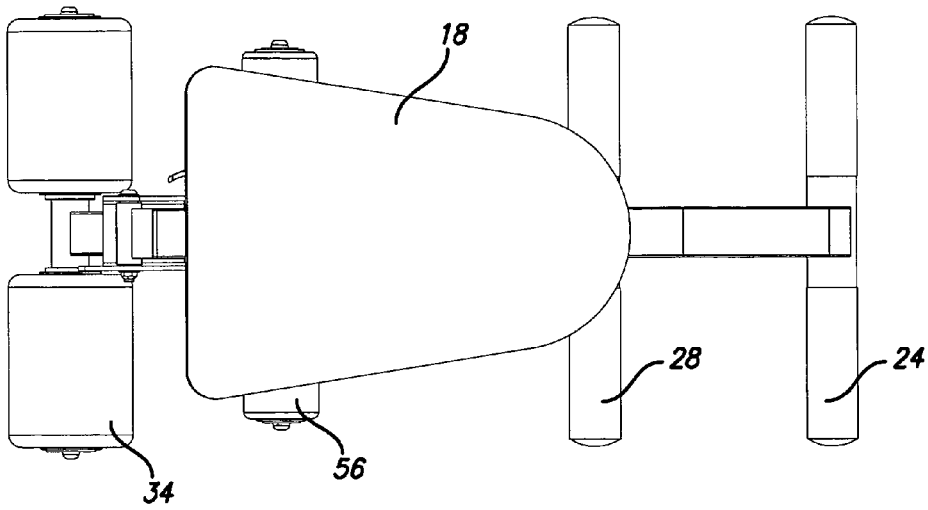
FIG. 13 is a top plan view of the bench in the storage position of FIGS. 11 and 12.
Figure 15A:
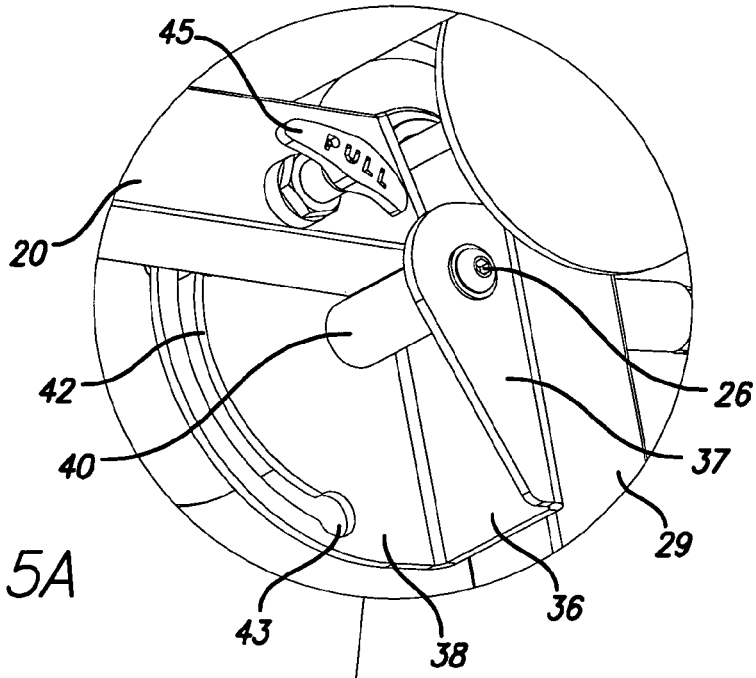
FIG. 15A is an exploded view of the pivotal connection circled in FIG. 15.
Figure 15:
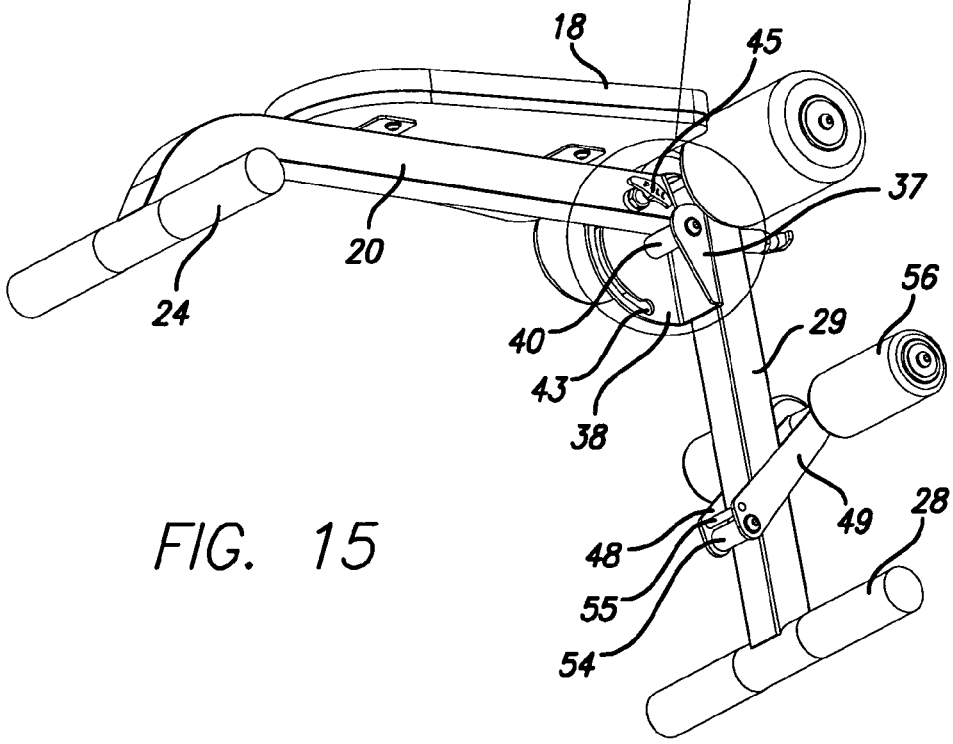
FIG. 15 is a rear perspective view from underneath the bench in the deployed position of FIG. 1, illustrating the pivotal connection between the frame and the folding front leg assembly.
Figure 16:
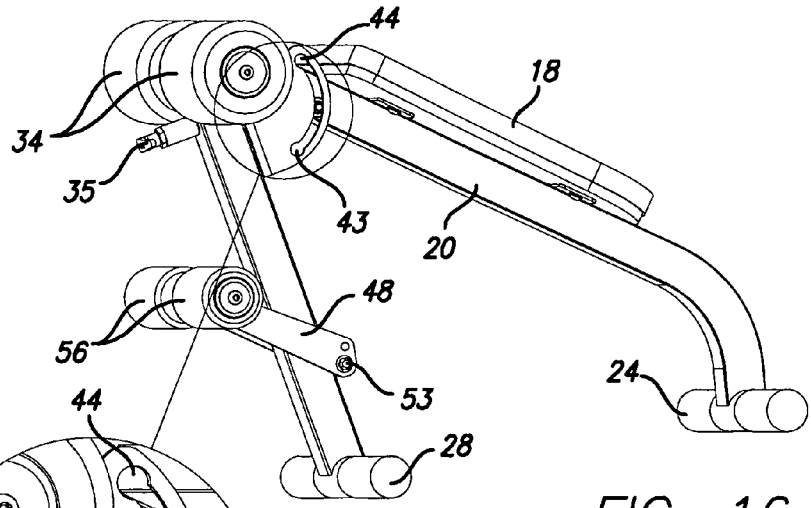
FIG. 16 is a perspective view of the exercise bench of FIGS. 1 to 15 at an intermediate position as the front leg assembly is being unfolded from a storage position to a deployed position.
Figure 16A:
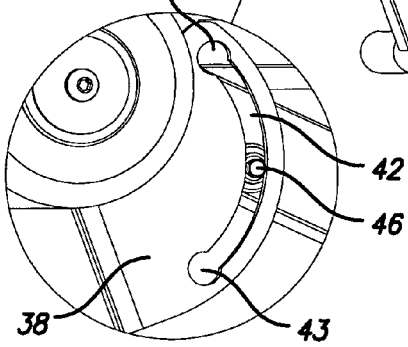
FIG. 16A is an enlarged view of the circled portion of FIG. 16, illustrating the range of motion plate.
Figure 17A:
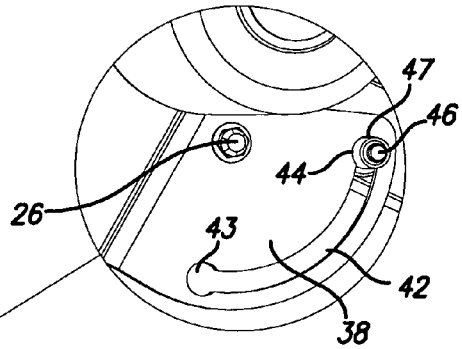
FIG. 17A is an enlarged view of the circled portion of FIG. 17, illustrating the range of motion plate.
Figure 17:
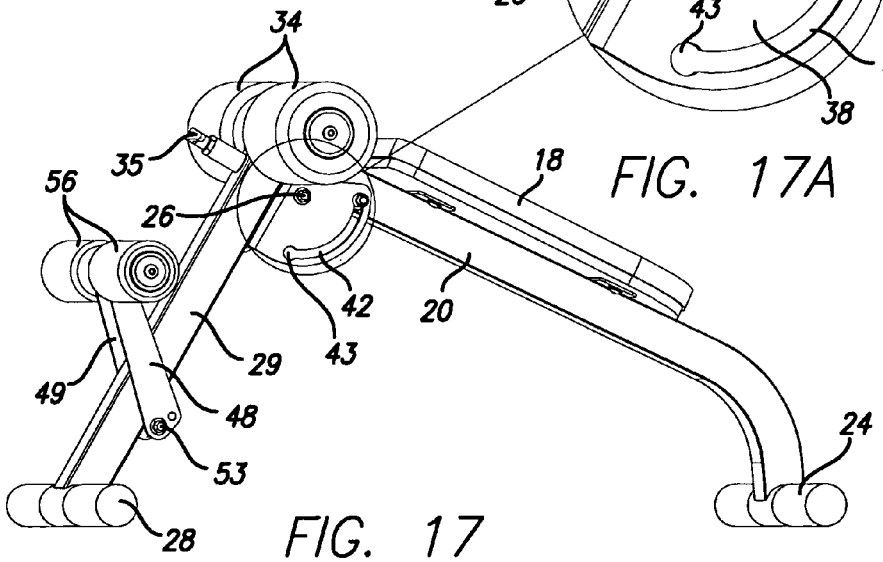
FIG. 17 is a perspective view of the exercise bench with the front leg assembly in the deployed, exercise position.

A "U" shaped mounting bracket 36 is attached by its web to the rear wall of the front leg 29, opposite the pull pin 35. The mounting bracket has a first rearward protruding leg 37 and second rearward protruding leg 38 which is longer and larger in dimensions than the first leg, as best illustrated in FIGS. 5, 11 and 15. The pivot pin 26 extends through a first opening in the first leg 37, a round tube 40 welded to the front plate 22 of the main tube, and through a second, aligned opening in the second leg 38 so as to pivotally connect the front support leg 29 to the main frame, as best illustrated in FIGS. 11 and 15A. This pivotal connection allows the front support leg to fold rearward, up against the underside of the main support frame. The second leg has an arcuate slot 42 approximate its rearward edge with opposite bulbous ends 43, 44, as best illustrated in FIG. 4. A pull pin 45 is mounted on one side wall of the main support frame's main tube. The pull pin 45 has a larger diameter body 47 with a smaller diameter tip 46 which engages in the arcuate slot 42 of bracket 36 secured to the front support leg 29, as illustrated in FIGS. 15 to 17. The bulbous ends 43, 44 of the arcuate slot provide locking positions for the storage position (see FIG. 11) and the exercise positions (see FIGS. 4 and 6). When the leg is pivoted about pivot pin 26, the end or tip 46 of the pull pin will travel along slot 42. The stepped design of the pull pin plunger ensures that the pull pin will always engage with the slot, for added safety. When the pull pin is aligned with one of the enlarged, bulbous ends of the slot, the larger diameter portion 47 of the pull pin will extend into the enlarged end of the slot, locking the pin in position and thus locking the leg 29 in its end position (either folded or deployed).

The foot stabilizer 15 is generally T-shaped and is pivotally connected to the front support leg 29 at a location intermediate the leg's two ends. The stabilizer comprises two, spaced plates 48,49 on opposite sides of the front leg 29 with a pair of holes located towards the first end of each plate, and a user engaging cross bar 52 transversely connected to each plate at their respective second ends. The plates are spaced to allow them to pass around the sides of the support leg and pivotally mount the stabilizer to a round tube 54 welded on the support leg's rear wall, as best illustrated in FIG. 15. This allows the foot stabilizer to pivot about a pivot axis 53 extending through the first pair of aligned plate holes. A bolt or pin 55, also illustrated in FIG. 15, is transversely connected through the second of the pair of plate holes in plates 48 and 49, and acts as a stop means to limit the range of motion of the foot stabilizer about its pivotal connection to the front support leg. Roller pads 56 are mounted to the ends of the user engaging cross bar for added comfort and to create a larger contact surface. Upward rotation of the stabilizer about pivot 53 (FIG. 4) is limited by the engagement of the cross bar 52 with the front side of the leg 29. Downward rotation of the stabilizer is limited by engagement of the stop pin 55 with the rear face of the leg 29. Because of the stop means which limits rotation of the stabilizer in the forward direction, the stabilizers or foot and ankle engaging pads will never pivot out of the exercise ready position and are always readily accessible to the user.

As noted above, FIGS. 1 to 5 illustrate the exercise bench in a first deployed position for performing abdominal crunch exercises. In the position of FIGS. 1 to 5, the upper pads 34 are in a lower position adjacent the front edge of seat pad 18, and the front support leg 29 is rotated into the deployed, forwardly inclined position with the floor engaging cross support 28 engaging the ground and the pull pin 45 extending through the bulbous end 44 of slot 42 to lock the leg 29 in the illustrated position. FIG. 4 illustrates the self-aligning capabilities of the foot stabilizer, since it can pivot freely about pivot 53 between two end positions. FIG. 4 illustrates two possible positions of the foot stabilizer in solid and dotted outline, respectively.

FIG. 5 illustrates a user 60 performing a seated abdominal exercise. In FIG. 5, hidden lines have been revealed to better show the various components. In this case, the user is seated on seat pad 18 facing forwardly, with their legs extending over thigh pads 34, which engage behind the user's knees. The legs are then bent downwardly with the feet engaging behind or hooking under the foot stabilizer pads 56 so that the feet are anchored. It will be understood that the user's legs will be located on opposite sides of the front support leg 29. The upright position of FIG. 5 represents both the start position and the finish position for the exercise, with the arrows indicating the exercise motion. The reclined position is the intermediate position when the abdominal muscles are under tension. The user will bend backwardly about their waist from the upright start position until they are in the rearwardly reclined position, and will then bend back upwardly into the upright position. Because the seat pad is inclined, the user must use their stomach muscles to pull their body up hill, against the force of gravity. The greater the angle of the seat pad (or the elevation between their knees and hips), the greater the effort required to return the body to the starting, upright position. Because of its pivotal attachment to the front support leg 29, the foot stabilizer 15 automatically pivots to adjust to the leg length of the user.

Figure 18A:
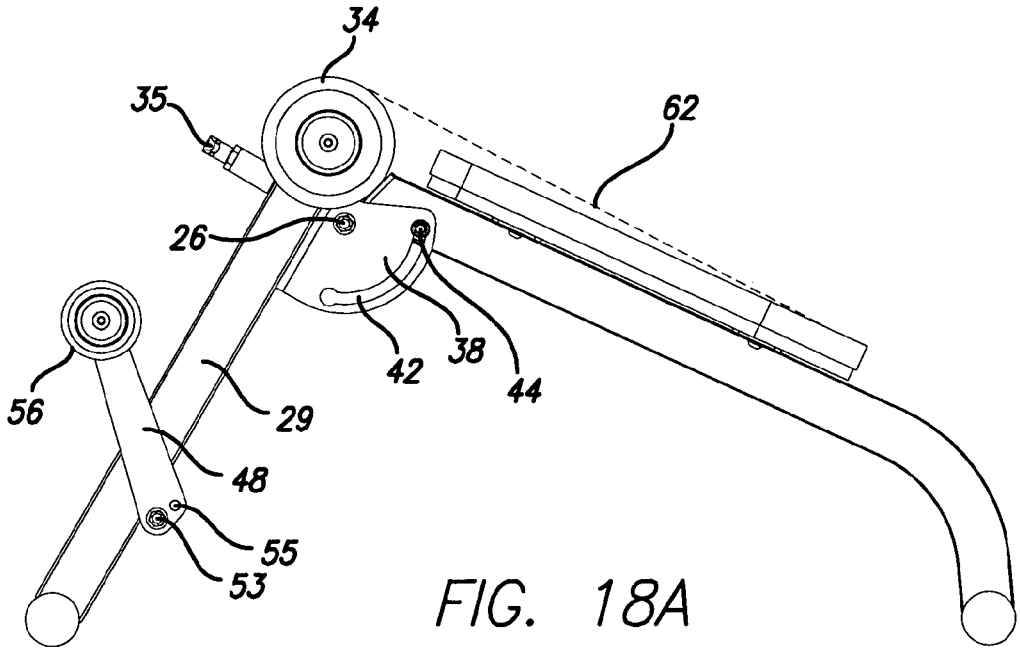
FIG. 18A is a side elevation view of the exercise bench of FIGS. 1 to 17 with the bench in position for performing abdominal exercises and the adjustable thigh support rollers in their lowest position.
Figure 18B:
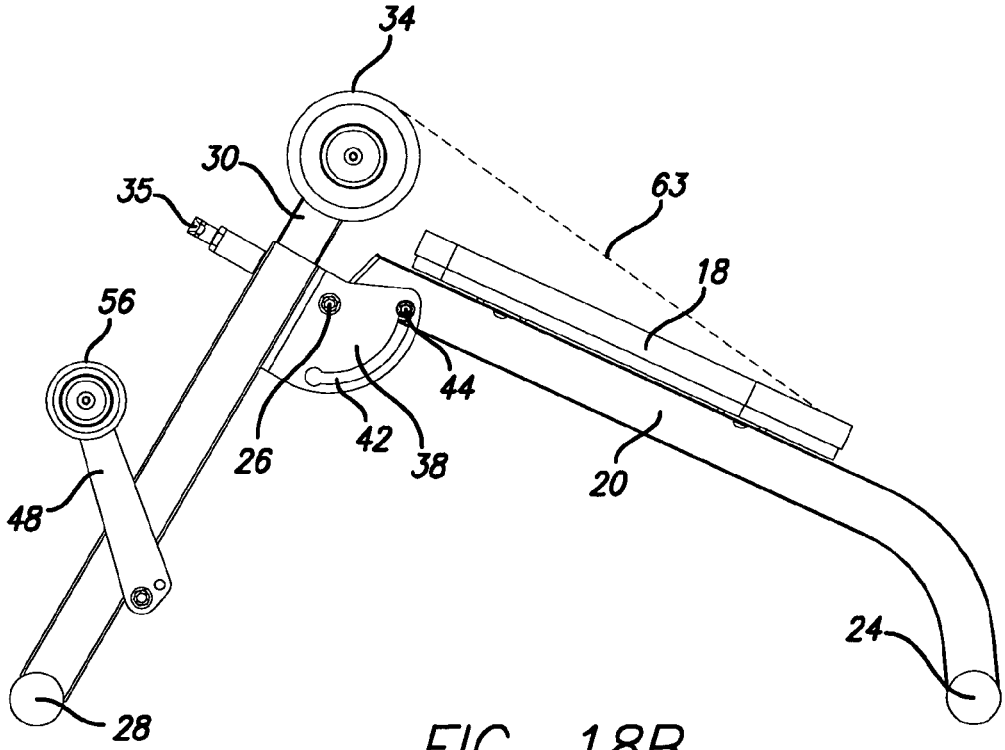
FIG. 18B is a side elevation view similar to FIG. 18A showing the adjustable thigh support rollers in a raised position.

FIGS. 18A and 18B illustrate how the angle of the user's body for performing abdominal crunch exercises can be adjusted. In FIG. 18A, the adjustable rollers 34 are in their lowest position while FIG. 18B shows the rollers 34 in a slightly elevated position. The rollers are adjusted by pulling the pull pin 35 outwardly and lifting the adjustment rod 30 until the rollers 34 are at the desired height, and then releasing the pull pin 35 to extend through the aligned opening 32 in the front wall of rod or tube 30. Raising the rollers 34 increases the amount the user's knees are raised above their hips. The dotted lines 62, 63 in FIGS. 18A and 18B represent the line of the user's upper leg when they are seated on the bench as depicted in FIG. 5. By slightly raising the adjuster tube, the roller pads will change the user's seated angle from 27 to 36 degrees while the roller height is changed from 21.5 inches to 24.25 inches. The steeper the seated angle of the user, the greater the gravitational influence of their body weight on the exercise.

A similar adjustment is also used to vary the height of the roller pads 34 so as to provide thigh support when performing back exercises, as illustrated in FIGS. 6 to 10. It can be seen from FIGS. 6 and 7 that the adjuster tube 30 has two sets of openings 32, with the upper set engaging the pull pin 35 to adjust the height of pads 34 when the user is performing seated abdominal exercises, as described above. The lower set of openings 32 is used to adjust the height of thigh pads 34 when performing lower back exercises. With the front support leg 29 in its deployed position, the user pulls out the pull pin 35 and raises the pads 34 to the desired height so that they will engage the front of the user's thighs as in FIG. 10. The pad height will be dependent on the length of the user's legs, and the openings provide a wide range of adjustability for users of different heights. The pin 35 is then released to extend through the aligned opening and secure the pads 34 in the raised position.

Figure 10:
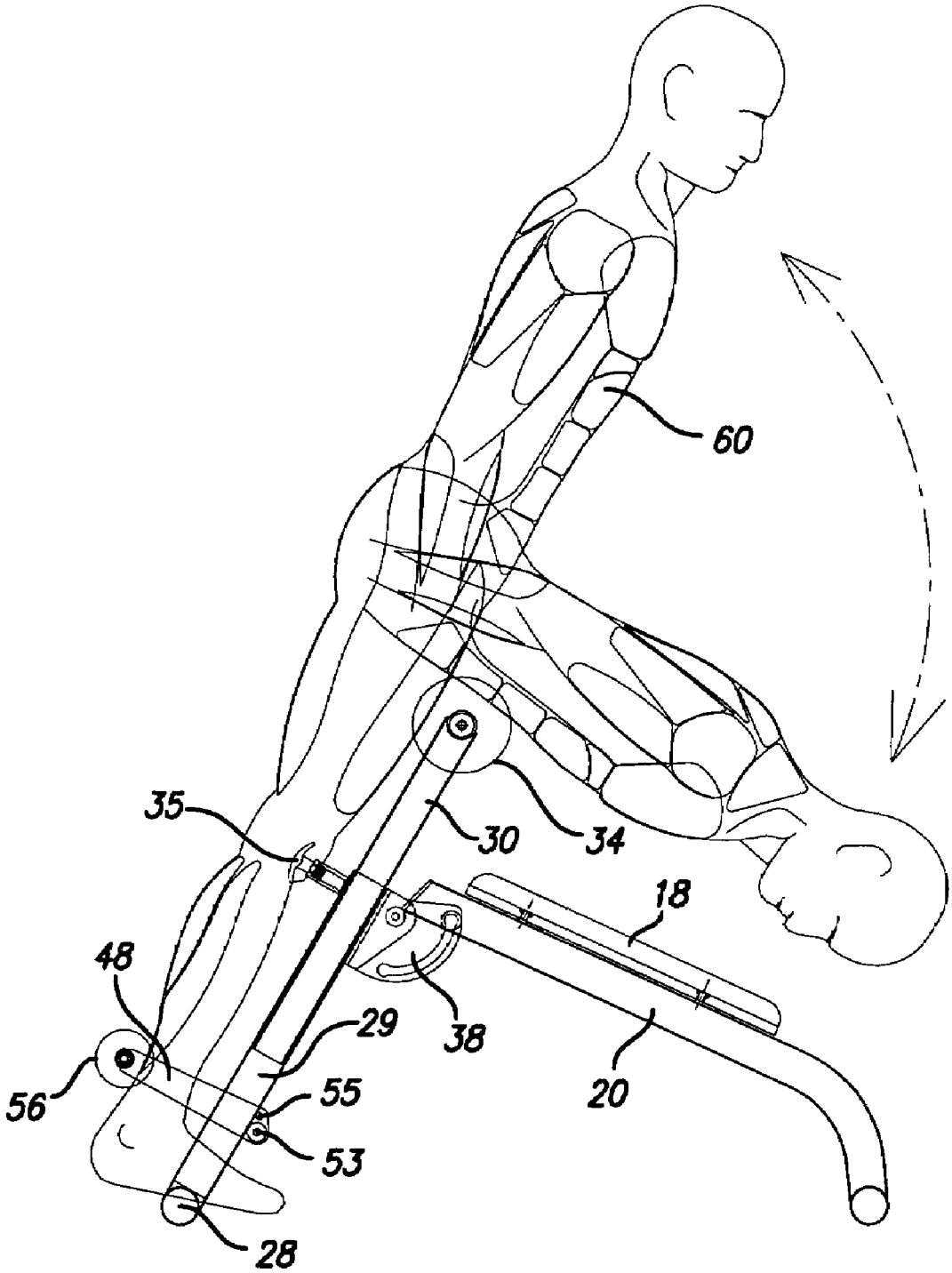
FIG. 10 is a side elevation view similar to FIG. 9, illustrating a user performing a low back exercise.

The user 60 then stands facing the rear of the bench, as illustrated in FIG. 10 with their feet planted on the folding assembly's floor engaging cross member 28 and their heels fitted under the user engaging cross bar 52 and pads 56 of the foot stabilizer, leaning slightly forward against the thigh pads 34. Once they are locked in place, making contact with both the thigh support and the foot stabilizer, they bend over at the waist until their low back muscles are under tension, as indicated in the forwardly bent position of the user in FIG. 10, and then return to the starting position. Because the floor engaging section of the folding assembly is forward of the thigh support, the user is placed in a forwardly inclined starting position. This means their torso is already under the influence of gravity, which increases the minute they start the exercise by bending forward and force their low back muscles to resist the effects of gravity.

Figure 14:
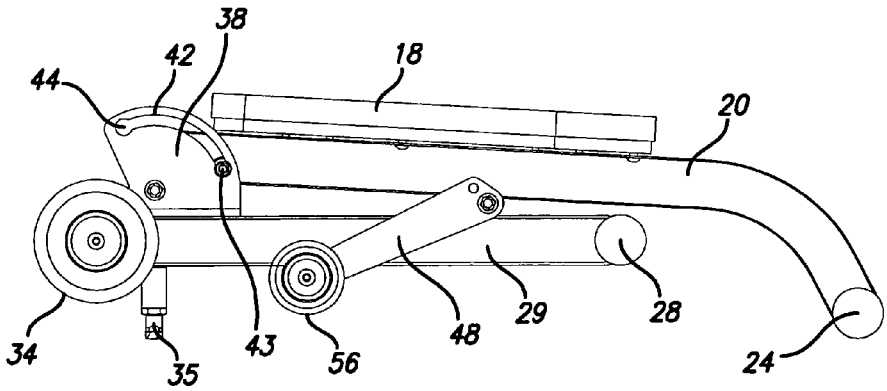
FIG. 14 is a side elevation view of the bench in the storage position of FIGS. 11 to 13.

FIGS. 11 to 14 illustrate the bench 10 in the folded or storage position. In order to fold up the bench for storage, the pull pin 45 (FIG. 15) is pulled out to release the larger portion of the pin from the bulbous end 44 of the slot 42, and the front support leg 29 can then be folded rearwardly and upwardly about pivot 26 until it is positioned adjacent the lower surface of main tube 20, as indicated in FIG. 14. At this point, the end 46 of the pull pin will have traveled along the slot 42 up to the opposite bulbous end 43, and the released lock or pull pin 45 will spring out so that the larger diameter portion 47 enters the enlarged end 43 of the slot, locking the leg 29 in the folded position. It can be seen that the folded leg 29 tucks up within the framework of the bench in the folded position, with the ground engaging member 28 at the end of the leg 29 being spaced from bent end portion of the main tube 20 and the entire folding assembly being raised above the cross support 24 at the first end of the tube. The foot stabilizer 15 is also folded up against the support leg 29 in a compact manner. Because the user engaging roller pads 56 on the foot stabilizer are at a spacing wider than the width of the support leg 29, they can fold up past the front wall of leg 29, providing a more compact folded profile and keeping the pads protected within the curved framework of the main support frame.

FIGS. 19 to 36 illustrate an exercise bench 70 according to a second embodiment of the invention. This embodiment is similar to the first embodiment but has the thigh support mounted at the end of a seat pad on the main frame rather than on an adjuster tube slidably mounted in the front leg, and the seat pad in this case is pivotally mounted on the main frame and adjusted by extending the length of the front leg, as described in more detail below. The exercise bench is movable between a first exercise position as illustrated in FIGS. 19 to 23, 35 and 36 for performing abdominal crunch exercises, a second exercise position as illustrated in FIGS. 24 to 28 for performing back hyper-extension exercises, and a folded or storage position as illustrated in FIGS. 29 to 34.

The exercise bench 70 has a main support frame that has a downwardly angled main tube 72 with a floor engaging, round cross support 75 transversely attached to a first end and a U-shaped support bracket 74 (see FIG. 27) secured to its second end. A folding front leg assembly 73 is pivotally attached to the second end of the main tube 72. The main tube has a straight section and a downward curving section extending to the cross support 75. An elongate "U" shaped channel 76 is secured to the upper surface of the straight section of the main tube, as illustrated in FIGS. 22, 23, 24 and 27, with the channel's side panels 78 mounting to the side walls of the main tube. The channel 76 is raised above the upper surface of main tube 72 with the raised portions of the side panels 78 each having a longitudinal guide slot 79 aligned with the corresponding slot in the other side panel, the arrangement being such that the slotted sections are located above the upper surface of main tube 72.

A seat assembly is pivotally mounted on the main tube 72. The seat assembly comprises a seat bracket 80 and a tapered seat pad 82 with an enlarged, rounded front end 84 mounted to the seat bracket for supporting the user. The rounded front end 84 provides thigh support for the user when they are performing back hyper-extension exercises and support behind the user's knee when they are seated and performing abdominal crunch exercises. The seat bracket 80 has a transverse tube 85 attached to a forward end (see FIGS. 25 and 28) and two ears 86 projecting downward and rearward at its rear end (see FIG. 24). Attachment holes are located approximate the end of each ear. The rear ears engage over the main frame's top channel and are connected by a pivot pin 88 that runs through the hole in a first ear, pivotally and slidably engages through both slots 79 in the channel and then engages through the hole in the second ear, as best illustrated in FIGS. 34 and 34B.

The folding front leg assembly 73 of the bench has a tubular front support leg 90 with an open first end and a floor engaging cross support 92 transversely attached at a second end. An adjuster tube 94 with multiple adjustment openings 95 (see FIG. 24) is inserted into the open first end of the front support leg for telescopic adjustment with the support leg. A pull pin 96 is mounted on the front wall of the support leg 90 adjacent its open end and extends through an opening in the front wall for engagement in a selected one of the openings 95 to lock the adjuster tube 94 at a selected extension. As best illustrated in FIGS. 34, 34A, a U-shaped bracket 98 is secured to the upper end of the adjuster tube 94 and has a pair of ears 99 which project rearwardly for engagement with a pivot pin 100 which extends through the transverse tube 85 at the forward end of the seat bracket 80. This pivotally secures the forward end of the seat assembly to the upper end of the adjuster tube 94. A gap 102 is provided at the center of the rounded front end 84 of the seat pad 82 to provide clearance for the pivotal movement of the folding front leg assembly about pivot 100 (see FIGS. 19, 20, 21 and 25, for example)

Figure 19:
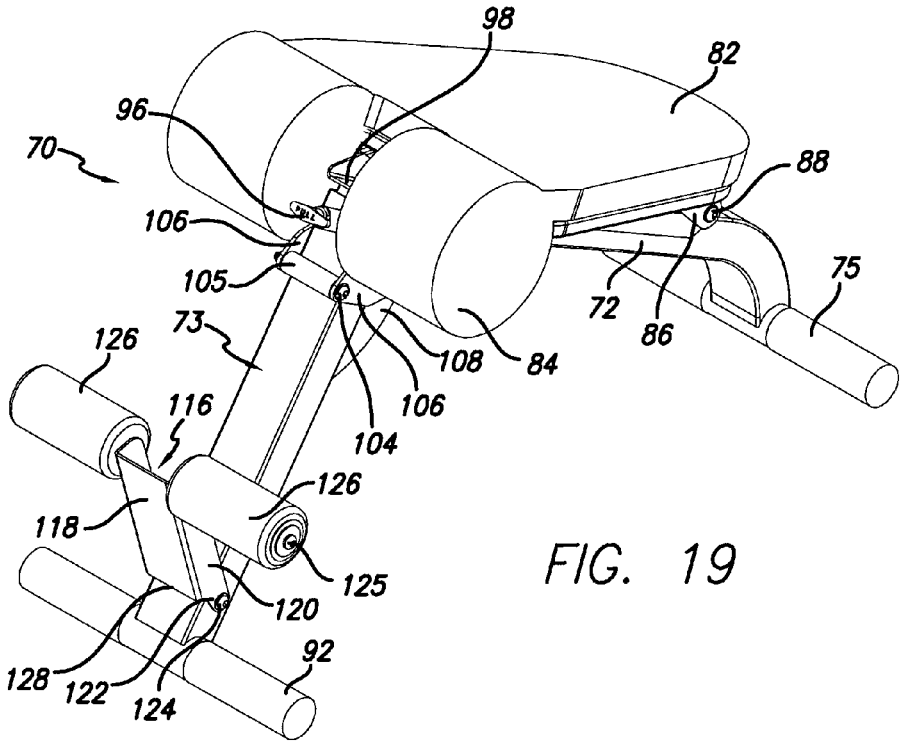
FIG. 19 is a perspective view of an exercise bench according to a second embodiment of the invention, with the bench in a first exercise position for performing abdominal crunch exercises.
Figure 20:
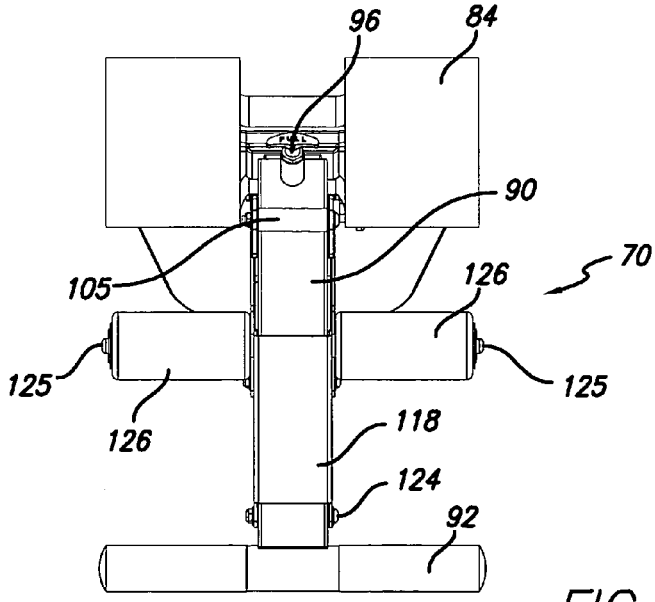
FIG. 20 is a front elevation view of the bench in the position of FIG. 19.
Figure 21:
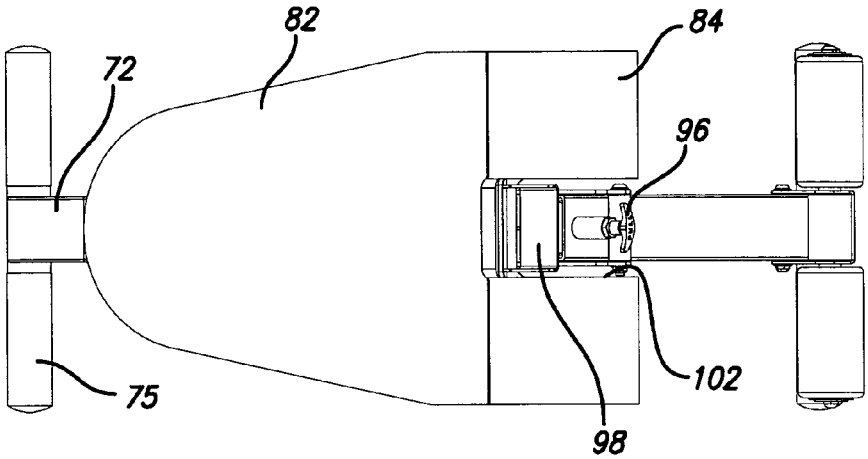
FIG. 21 is a top plan view of the bench of FIGS. 19 and 20.
Figure 22:
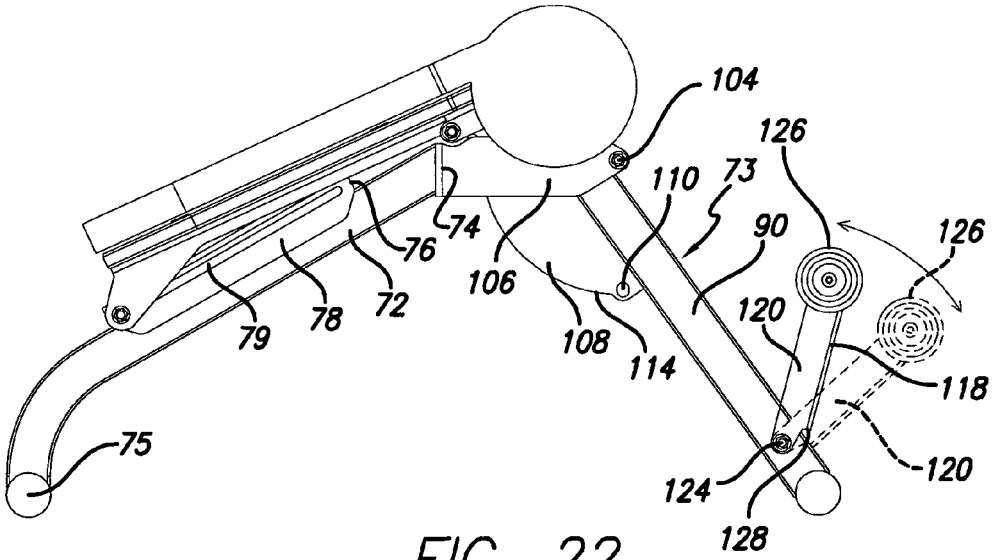
FIG. 22 is a side elevation view of the bench in the position of FIGS. 19 to 21.
Figure 24A:
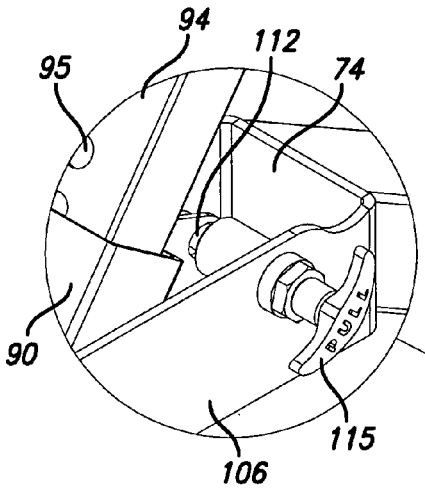
FIG. 24A is an enlarged view of the circled portion of FIG. 24 to illustrate the locking arrangement between the frame and the folding front leg assembly in the exercise position.
Figure 24:
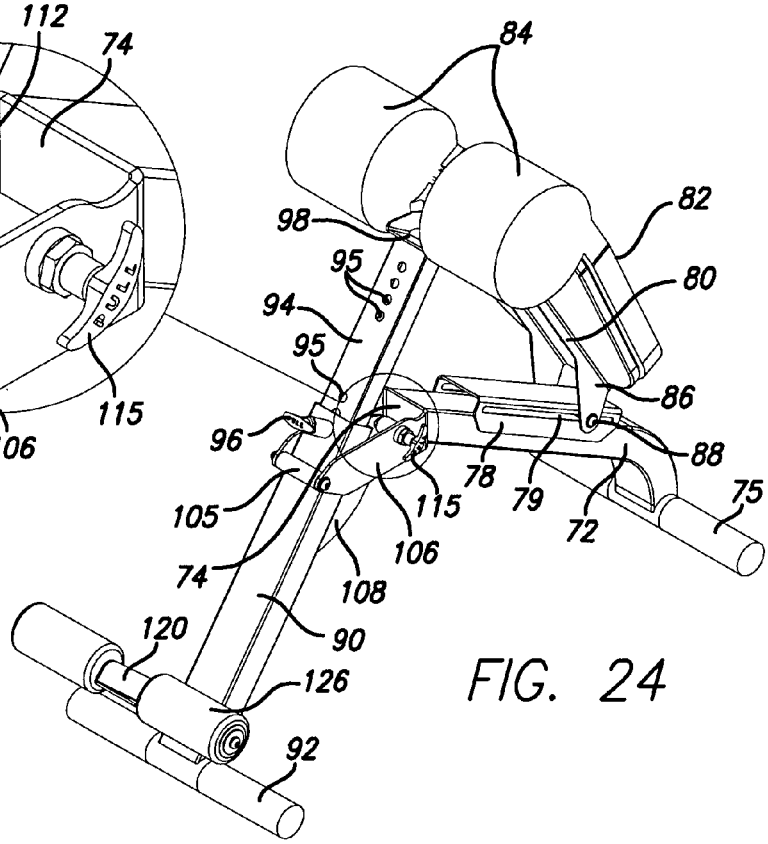
FIG. 24 is a front perspective view of the bench of FIGS. 19 to 23 in a second exercise configuration for performing back hyper-extension exercises.
Figure 25:
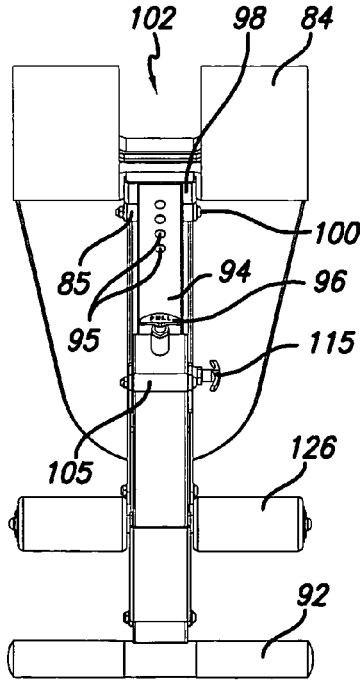
FIG. 25 is a front elevational view of the bench in the exercise position of FIG. 24.
Figure 26:
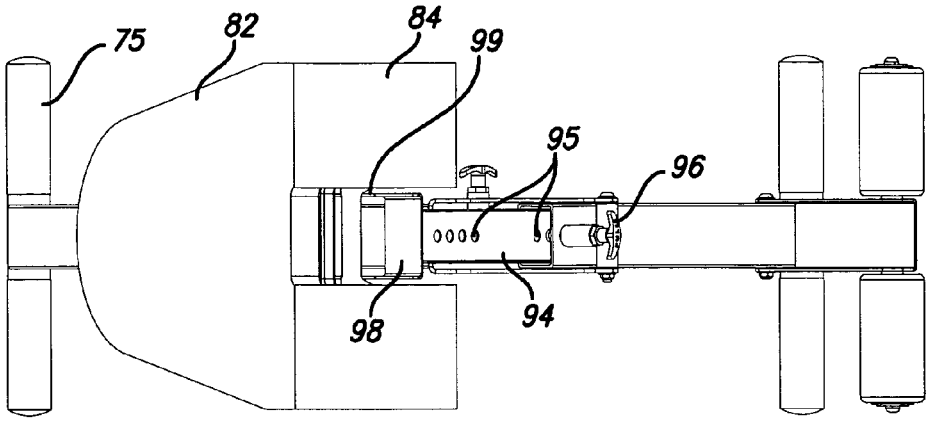
FIG. 26 is a top plan view of the bench positioned as in FIG. 24.
Figure 32:
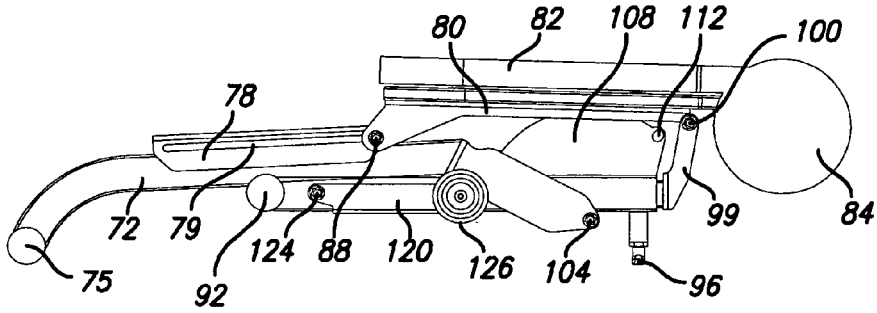
FIG. 32 is a side elevation view of the folded bench of FIGS. 29 to 31.
Figure 33:
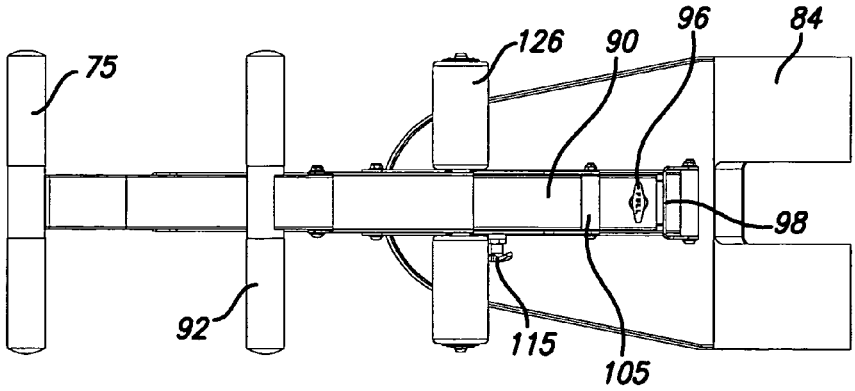
FIG. 33 is a bottom plan view of the folded bench of FIGS. 29 to 32.

The front support leg 90 is pivotally secured to the main tube 72 via a pivot pin 104 which is pivotally engaged in a mounting tube 105 which is transversely welded to the front or forward wall of the support leg at a location between the leg's two ends. The pivot pin 104 is secured between the forwardly projecting ears or plates 106 of the front bracket 74 of the main tube, as best illustrated in FIGS. 19 and 24, so as to pivotally connect the main support frame to the front support leg 90. The pivotal connection between the front support leg and forward bracket of the main tube 72 allows the front support leg to fold rearward, up against the underside of the main support frame. A rearward protruding plate 108 is attached to the rear wall of the support leg at a location behind mounting tube 105 and between the ears 106, as best illustrated in FIGS. 22 and 32. This plate has two spaced pinning holes 110 (FIG. 22) and 112 (FIG. 32) at opposite ends of its curved rearward edge 114 which provide locking positions for the storage (folded) and exercise positions. A pull pin 115 is located on one ear 106 of the support bracket, engaging one of the holes located in the support leg's rear plate 108, depending on whether the support leg is in the deployed position or the folded position. FIG. 24A illustrates the pull pin 115 engaging the hole 112 with the support leg in the deployed or exercise position. In the folded position of FIG. 33, the pull pin 115 will engage hole 110 to hold the support leg in the folded position.

Figure 27:
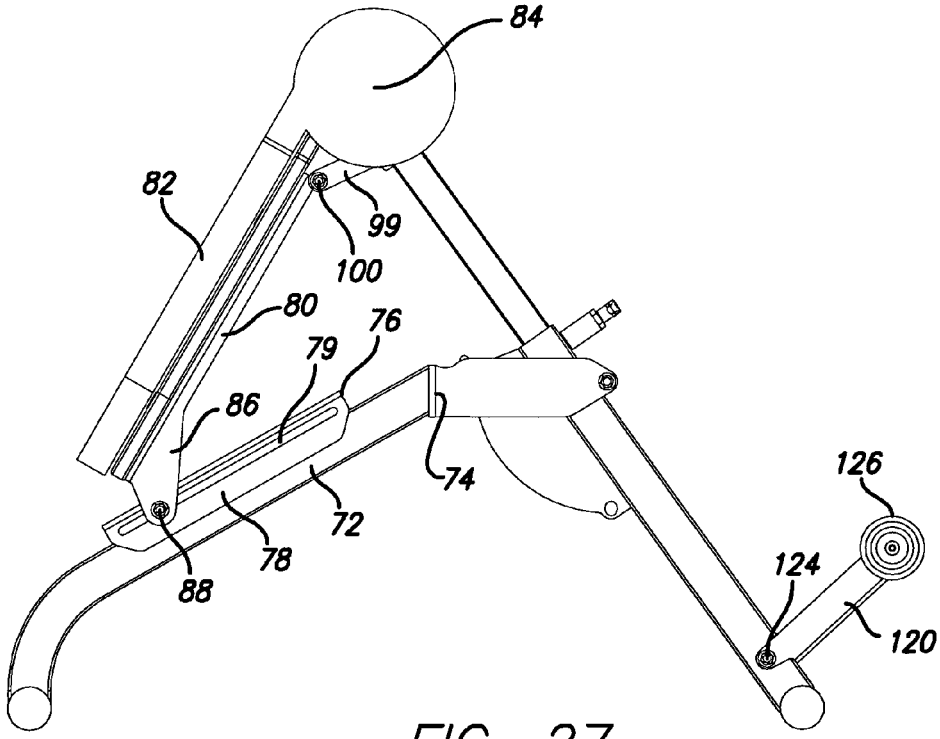
FIG. 27 is a side elevation view of the bench positioned as in FIG. 24.

A generally "T" shaped foot stabilizer is pivotally connected to the front support leg 90 at a location intermediate the leg's two ends. The stabilizer consists of a "U" shaped channel 116 with a central web 118 which is wider than the width of the front face of the leg 90 and which has two side legs 120. The rear ends of the side legs 120 have rearwardly projecting ears 122 which are pivotally secured to the support leg or tube 90 via a pivot pin 124 which extends through aligned openings in the projecting ears and the side walls of the tube, as best illustrated in FIGS. 19 and 22. Oppositely directed user engaging bars or rods 125 are transversely attached to the respective channel side leg at the second end of the channel. Roller pads 126 are mounted on each of the user engaging bars or rods of the foot stabilizer for added comfort and to create a larger contact surface. The central web 118 of the channel acts as stop means to limit the pivotal range of motion of the foot stabilizer about its connection to the front support leg. When the channel is pivoted upwardly, the inner face of the web will eventually contact the front face of the front support leg or tube 90 to limit rotation in this direction. When the channel is pivoted downwardly about pivot 124, the end edge 128 of the channel will eventually contact the front face of the tube 90 so as to limit rotation in the anti-clockwise direction, as indicated by the dotted lines in FIG. 22. FIGS. 24 and 27 also illustrate the stabilizer pads 126 in the lowermost stop position.

Figure 23:
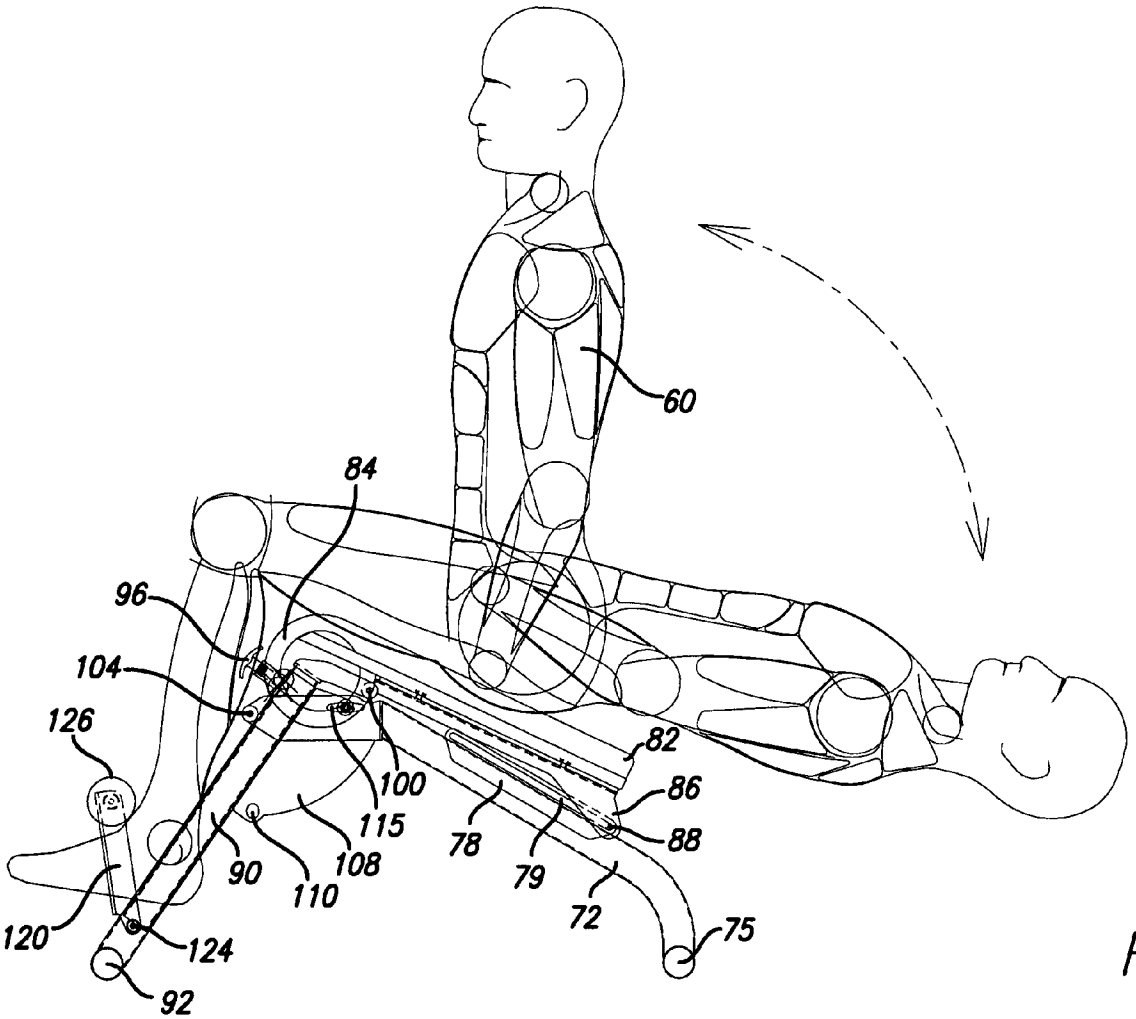
FIG. 23 is a side elevation view similar to FIG. 22 illustrating a user performing a seated abdominal exercise.

As noted above, FIGS. 19 to 33, 35 and 36 illustrate the bench 70 in a deployed or exercise position for performing abdominal crunch exercises. In FIGS. 19 to 33 and 35, the adjuster tube 94 and adjustable seat assembly are in the lowermost position with the tube 94 retracted as far as possible into the support leg or tube 90. FIG. 23 shows a user 60 performing an abdominal crunch exercise with the bench in this position. In FIG. 23, hidden lines have been revealed to better show the various components. The user will start in the upright position, seated on the seat pad 82 while facing forwardly with the knees engaging over the enlarged rounded ends 84 of the seat pad and the feet anchored under the foot stabilizer pads 126. Once in the proper position, the user will bend rearwardly at their waist until they reach the fully reclined position illustrated in FIG. 23, extending rearwardly over the seat pad 82 and stretching the abdominal muscles. The user then bends back upwardly into the upright position. Because the seat pad is inclined, the user must use their stomach muscles to pull their body up hill, against the force of gravity. The greater the angle of the seat pad (or the elevation between their knees and hips), the greater the effort required to return the body to the starting, upright position. Because of its pivotal attachment to the front support leg 90, the foot stabilizer automatically pivots to adjust to the leg length of the user.

Figure 35:
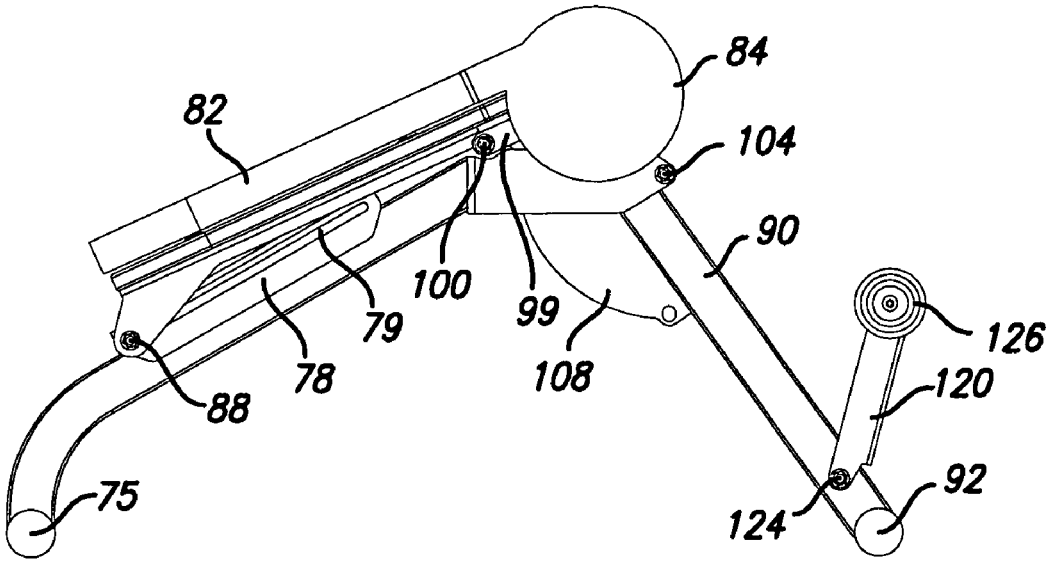
FIG. 35 is a side elevation view of the exercise bench of FIGS. 19 to 34 with the adjustable seat assembly in its lowest position.
Figure 36:
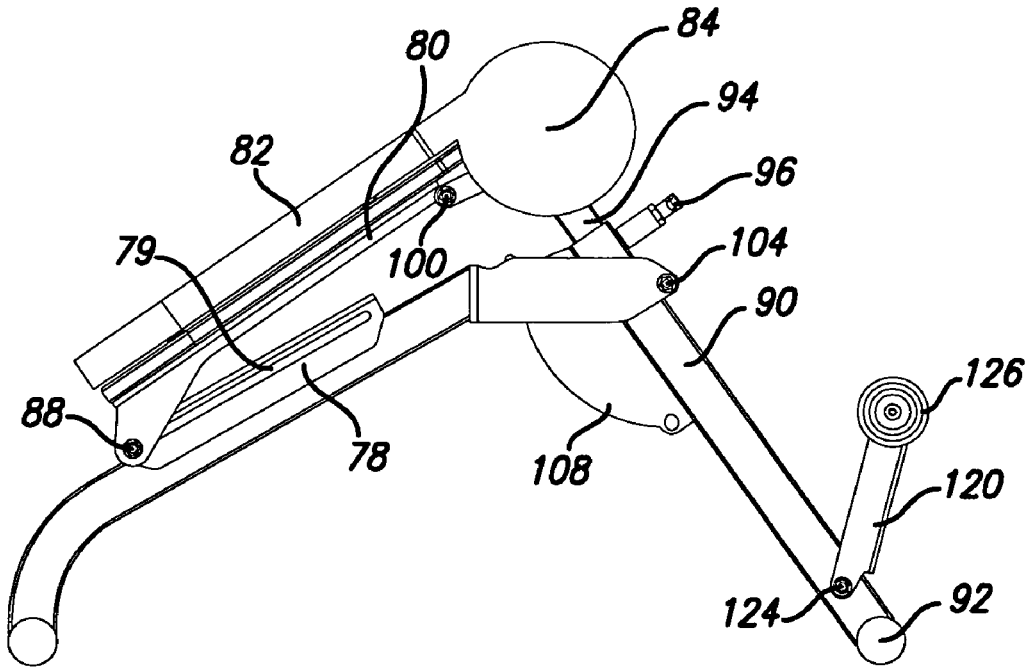
FIG. 36 is a side elevation view similar to FIG. 35 illustrating the seat assembly in a raised position.

FIGS. 35 and 36 show the ability to adjust the angle, and consequently the degree of difficulty, of the user position for an Abdominal Crunch exercise. FIG. 35 shows the adjustable seat assembly in its lowest position while FIG. 36 shows it slightly elevated, which increases the amount the user's knees are raised above their hips. By releasing the pull pin 96 and slightly raising the adjuster tube 94, the seat assembly changes the user's seated angle from 25 to 35 degrees and the user's knee height by over three inches (since the height of the upper face of the rounded end 84 of the seat pad is increased from about 23.5 inches to about 26.75 inches). The steeper the seated angle of the user, the greater the gravitational influence of their body weight on the exercise. This adjustment is also used to vary the height of the thigh support when performing back exercises, as will be described in more detail below.

Figure 28:
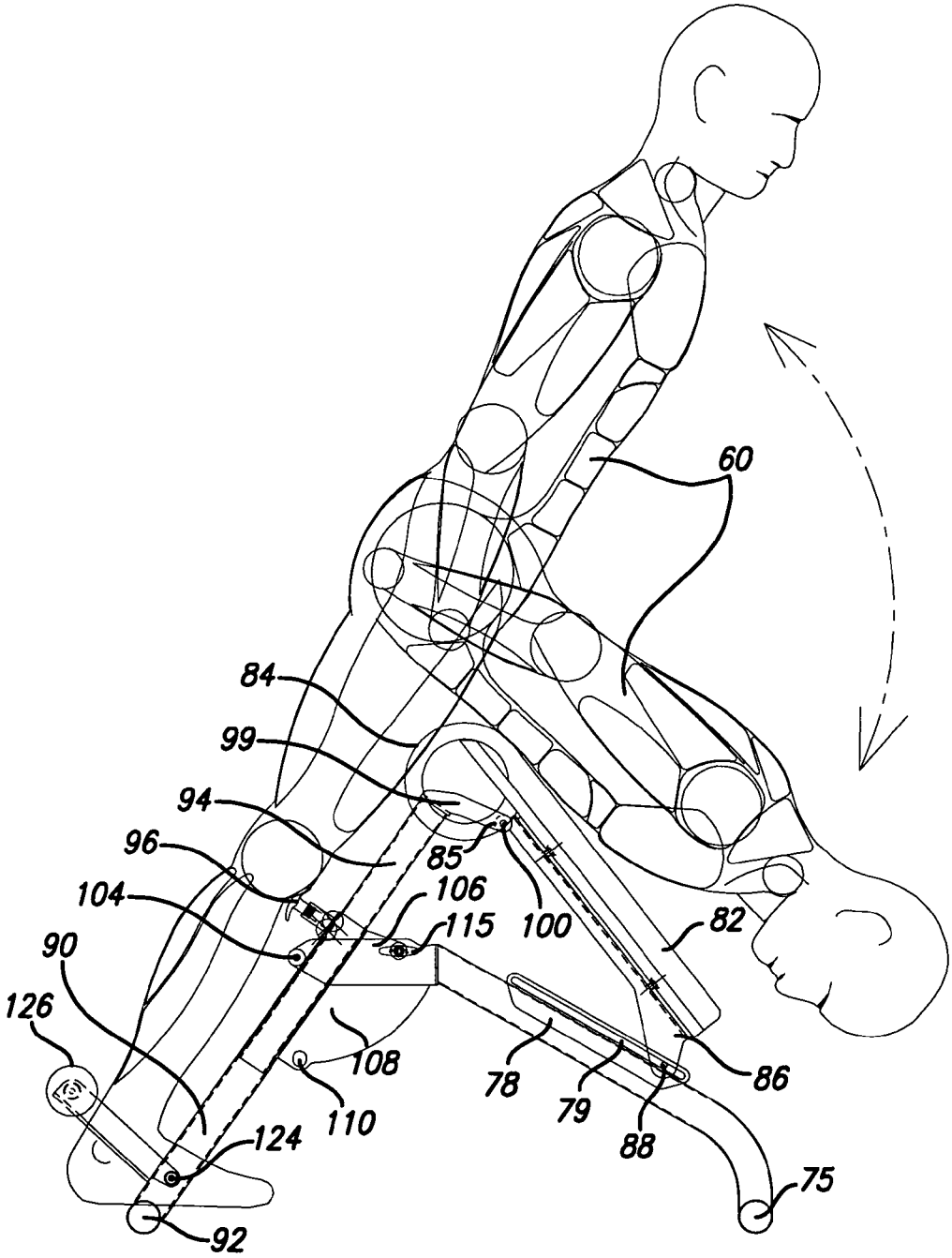
FIG. 28 is a side elevation view similar to FIG. 27 illustrating a user performing a low back exercise.
Figure 29:
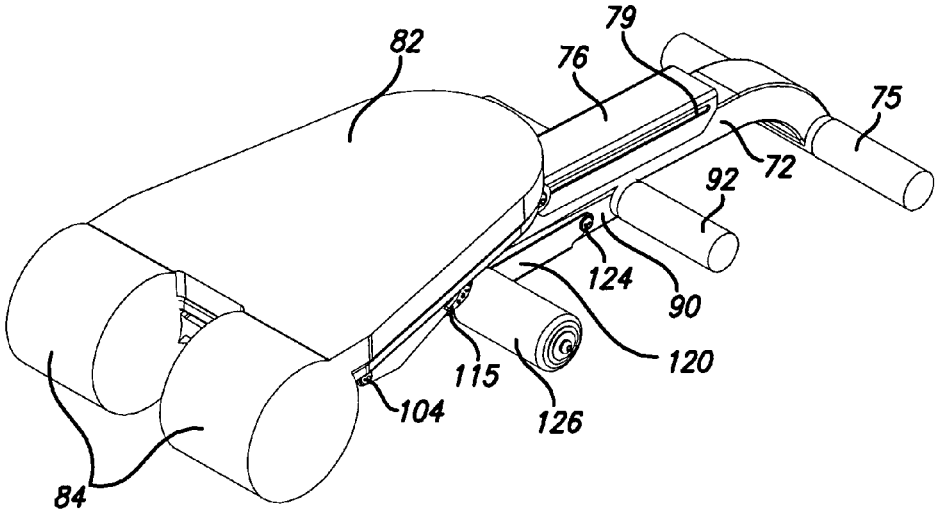
FIG. 29 is a perspective view illustrating the bench of FIGS. 19 to 28 in a folded or storage position.
Figure 30:
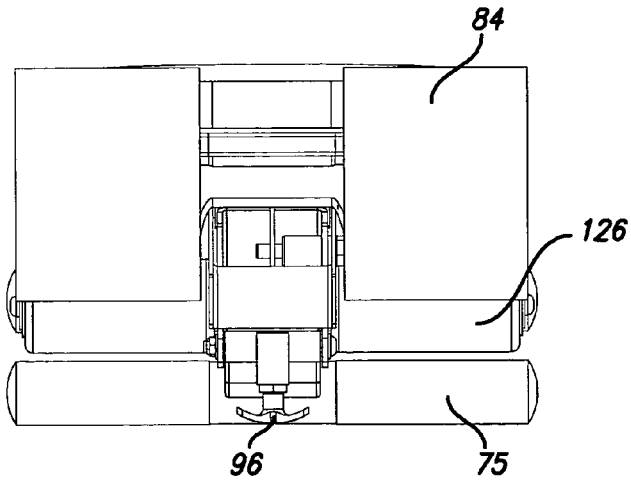
FIG. 30 is a front view of the folded bench of FIG. 29.
Figure 31:
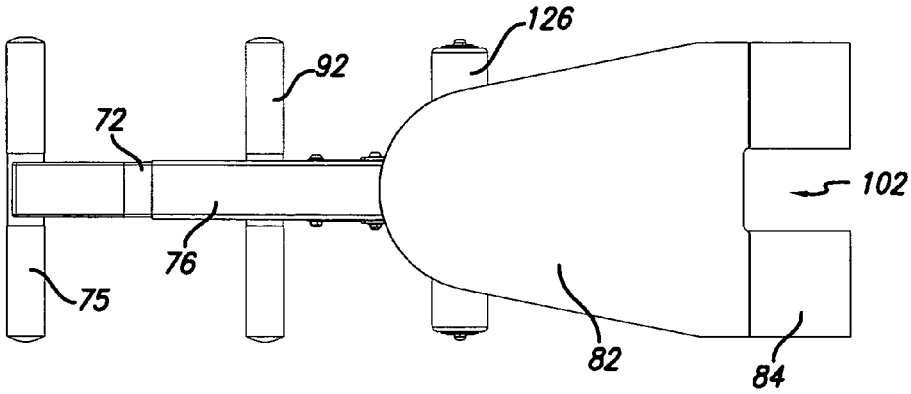
FIG. 31 is a top plan view of the folded bench of FIG. 29.

FIGS. 24 to 28 illustrate the adjuster tube 94 extended farther out from the front support leg or tube 90 and the resultant increased angle of the seat pad assembly so that the rounded front end 84 of the seat pad is at an even greater height from the floor. This position is suitable for performing a back hyper-extension exercise, since it raises the rounded front end of the pad for engagement by the user's upper thigh, and creates a steep angle to the seat which leaves room for the user's upper body when they lean forward to perform a lower back exercise. The seat pad assembly will be adjusted by the user until the rounded front end 84 of the seat pad, which in this case acts as a thigh support, is located for engagement with the upper thighs of user 60, as indicated in FIG. 28 which illustrates a user performing a back hyper-extension exercise. The user can easily adjust the height of the front end or support pad 84 by pulling out pin 96 and lifting the pad to the desired height, then releasing the pull pin to lock in the aligned opening 95 in the adjuster tube 94. As the adjuster tube is extended, the front end of the seat pad assembly is raised, and the rear end pivots about pivot pin 88, with the pin also sliding forwardly along the slots 79 in the channel member 76 mounted on top of the main frame tube 72 to accommodate the pivotal movement. When the adjuster tube is retracted downwardly into tube 90, the pin 88 will slide rearwardly along the slots 79.

In order to perform a lower back or back hyper-extension exercise, the user 60 stands facing the rear of the bench, as illustrated in FIG. 28, with their feet planted on the floor engaging cross member 92 of the front leg and their heels fitted in front of and under the pads 126 of the foot stabilizer, leaning slightly forward against the thigh pads 84. Once they are locked in place, making contact with both the thigh support and the foot stabilizer, they bend over at the waist until their low back muscles are under tension, as indicated by the arrows in FIG. 28, and then return to the starting position. Because the front support leg 90 is inclined generally rearwardly in the deployed or exercise position, the floor engaging cross member 92 is spaced forward of the thigh support pads 84, so that the user is placed in a forwardly inclined starting position. This means their torso is already under the influence of gravity, which increases the minute they start the exercise by bending forward and force their low back muscles to resist the effects of gravity.

FIGS. 29 to 34 illustrate the bench 70 in the folded or storage position. In order to move the bench from the deployed or exercise position into the storage position, the adjuster tube 94 is first lowered into the lowermost position, if extended, and locked in the lowered position. Pull pin 115 is then pulled back to release the pin from the opening 112 in plate 108 (FIG. 24A). The front leg assembly can then be rotated rearwardly about pivot 104 until it is positioned underneath and adjacent the main tube 72, as best illustrated in FIG. 32. At this point, the pull pin 115 will be aligned with the second opening 110 in the plate 108 and will be spring loaded to engage in this opening and lock the folding leg assembly in the folded position. When the front leg is folded rearward, the adjuster tube's pivotal connection 100 to the seat assembly swings forward, pulling the pin 88 attached to the rear of the seat assembly along the main frame's slotted channel 79 until it reaches the forward end of the channel, as indicated in FIG. 32.

The folded position allows the bench to be stored out of the way, in a closet or under a bed when not in use and allows the product to be boxed fully assembled for easier shipping. Notice that the front support leg 90 fits up against the underside of the straight section of the main tube 72, ending before the tube bends towards its first end 75. Also notice that the user engaging roller pads 126 on the foot stabilizer are spaced wider than the front support leg to allow them to fold up past the front wall of the leg. This provides a more compact folded profile and keeps the pads protected within curved frame work of the main support frame.

Figure 36A:
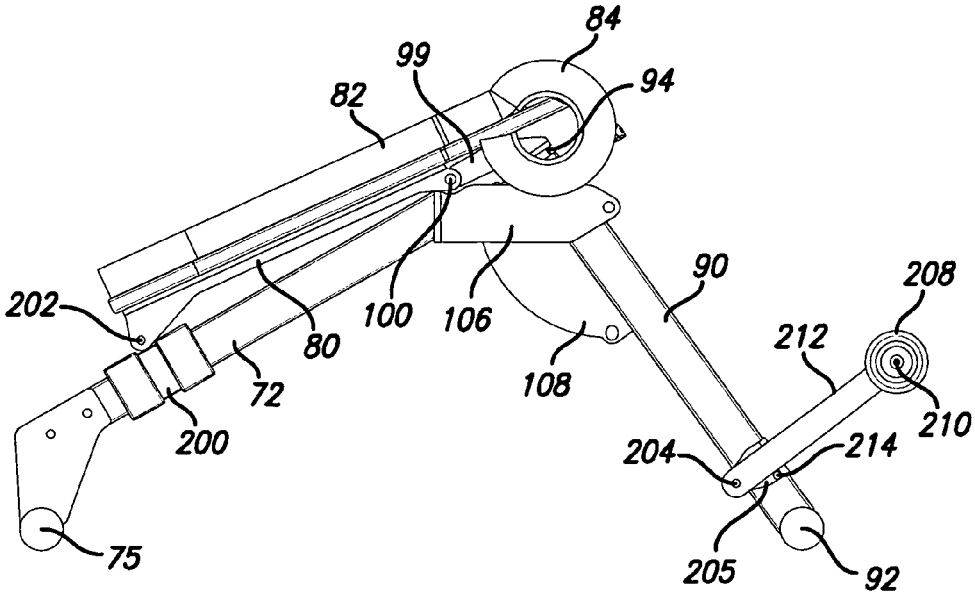
FIG. 36A is a side elevation view similar to FIG. 35 showing a modified pivot mounting for the adjustable seat assembly, with the upholstery cut away to show the front pivotal attachment.
Figure 36B:
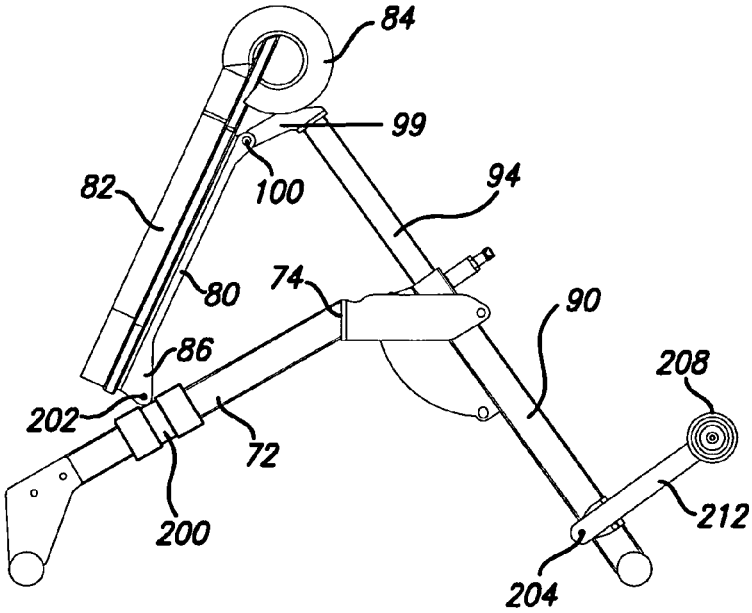
FIG. 36B is a side elevation view similar to FIG. 27 but showing the modified exercise bench of FIG. 36A, again with the upholstery cut away to show the front pivotal attachment.

In the embodiment of FIGS. 19 to 36, the rear end of the seat is pivotally and slidably mounted in a guide slot in a slide channel which is in turn mounted on the main support frame. FIGS. 36A and 36B illustrate a modification of the embodiment of FIGS. 19 to 36 which is designed to reduce the potential for pinch points. Some parts of the modified embodiment of FIGS. 36A and 36B are identical to corresponding parts of the embodiment of FIG. 19 to 36, and like reference numbers have been used for such parts, which are not described in detail in connection with FIGS. 36A and 36B. Instead, reference is made to the foregoing description of these parts in connection with FIGS. 19 to 36.

In the modified embodiment of FIGS. 36A and 36B, instead of pivotally and slidably mounting the rear end of the seat in a guide slot of a slide channel on the main support frame, the rear end of the seat is instead pivotally mounted on a slide member or sliding carriage 200 via pivot 202. The carriage 200 slides along the length of the seat supporting portion of the main frame 72 when the seat is pivoted up and down. As in the previous embodiment, the height of the enlarged support pad 84 at the forward end of the seat pad 82 can be adjusted by adjusting the extension of the adjuster tube 94 out of the upper end of front leg 90. By extending tube 94 upwardly, the seat pad 82 is pivoted upwardly at its forward end about pivot 100 and its rearward end about pivot 202, and the carriage 200 slides forwardly along main frame 72 to accommodate the pivoting motion. This will raise the height of the enlarged forward end or support pad 84.

FIG. 36A shows the lowermost position of the seat pad 82, with the bench and seat pad in position for performing abdominal crunch exercises. Comparison of FIG. 36A with FIG. 35, which shows the equivalent lowermost position of the embodiment of FIGS. 19 to 36, shows that the pinch risk is substantially reduced in the modified embodiment of FIG. 36A, due to the larger gap between the undersurface of seat support bracket 80 and the upper surface of the main frame 72 beneath the seat.

FIG. 36B shows the adjuster tube 94 extended out from the front support leg 90 so as to raise the rounded front end 84 of the seat pad to a position suitable for performing back hyperextension exercises, as described above in connection with FIGS. 24 to 28. In the modified embodiment of FIGS. 36A and 36B, the sliding carriage or sleeve 200 slides forwardly along main frame tube 72 as the seat is pivoted upwardly.

As in the previous embodiment, a foot stabilizer is pivotally connected to the front support leg 90 at a location intermediate the leg's two ends. Unlike the previous embodiments, in which the foot stabilizer is mounted at a fixed position on the front support leg, the foot stabilizer in FIG. 36A is pivotally mounted via pivot pin 204 on a bracket 205 slidably mounted on the front support leg 90 and secured in a selected position by pull pin 206. This allows the foot stabilizer to be adjusted along the length of the front support leg to accommodate users having different length legs. The foot stabilizer itself is similar to the foot stabilizer of the first embodiment, and has a pair of pads 208 mounted on opposite ends of a support rod 210. A pair of spaced pivot mounting plates 212 extend on opposite sides of the front support leg 90 and are secured to the support rod 210 at one end, and pivotally mounted at the rear end of the sliding bracket 205 via pivot 204 with a pivot pin (not shown) extending through the aligned openings in the sliding bracket and the spaced mounting plates. Stop pins 214 on each side of bracket 205 limit the downward rotation of the foot stabilizer by engaging the lower edges of the plates 212.

The bench of FIGS. 36A and 36B is adjustable between the different exercise positions and the folded position in the same way as described above in connection with FIGS. 19 to 36, with the exception of the difference in the pivotal mounting of the rear end of the seat pad. As in FIGS. 19 to 36, the modified bench of FIG. 36A is movable into a folded position which allows the bench to be stored out of the way, in a closet or under a bed when not in use and allows the product to be boxed fully assembled for easier shipping. The user engaging roller pads 208 on the foot stabilizer are spaced wider than the front support leg 90 to allow them to fold up past the front wall of the leg in the folded position, as do the roller pads 126 of the previous embodiment when the bench is folded as in FIG. 32.

FIGS. 37 to 57 illustrate an exercise bench 140 according to another embodiment of the invention which is adjustable between deployed or exercise positions for performing abdominal crunch or back hyper-extension exercises, and a folded or storage position. As in the first two embodiments, the bench 140 has a main frame supporting a seat pad assembly and a front support leg 142 which is foldable between exercise and folded positions. Unlike the previous embodiments, the seat pad assembly in this case is a split seat with a pivoting first seat pad and a fixed second seat pad, with the forward end of the pivoting seat pad secured near the second end of the main tube, as will be described in more detail below.

Figure 50:
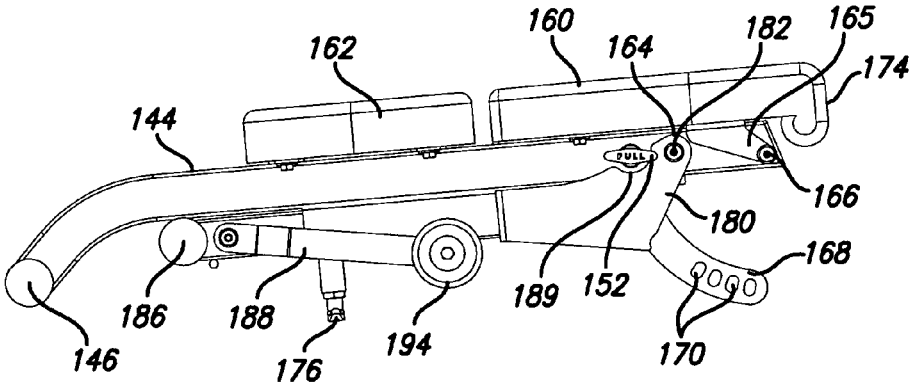
FIG. 50 is a side elevation view of the bench in the folded position of FIG. 47.
Figure 51:
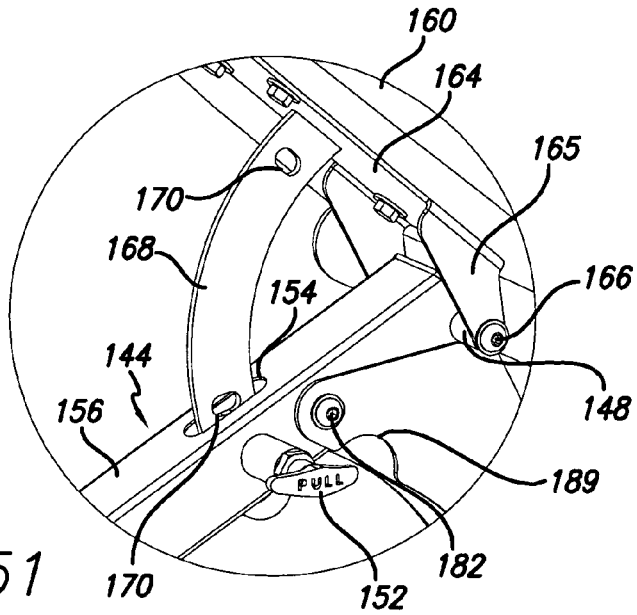
FIG. 51 is an expanded perspective view of the adjustable seat bracket from underneath the front pad, illustrating how the curved adjuster plate passes through the main frame.

FIGS. 37 to 41, 56 and 57 illustrate the bench in a position for performing abdominal crunch exercises, while FIGS. 42 to 46 illustrate the bench positioned for performing back hyper-extension exercises, and FIGS. 47 to 50 illustrate the bench in a folded or storage position. The bench 140 has main support frame that has a downwardly angled main tube 144 with a floor engaging, round cross support 146 transversely attached at a first end and a support plate 145 secured over its open second end. The support plate 145 adds strength to the second end and keeps the main tube from collapsing under the weight of the user. The main tube has a straight section extending from the second end and a downward curving section extending up to the first end. A mounting tube 148 is transversely attached approximate the second end of the main tube, as best seen in FIGS. 51 and 55.

Figure 40:
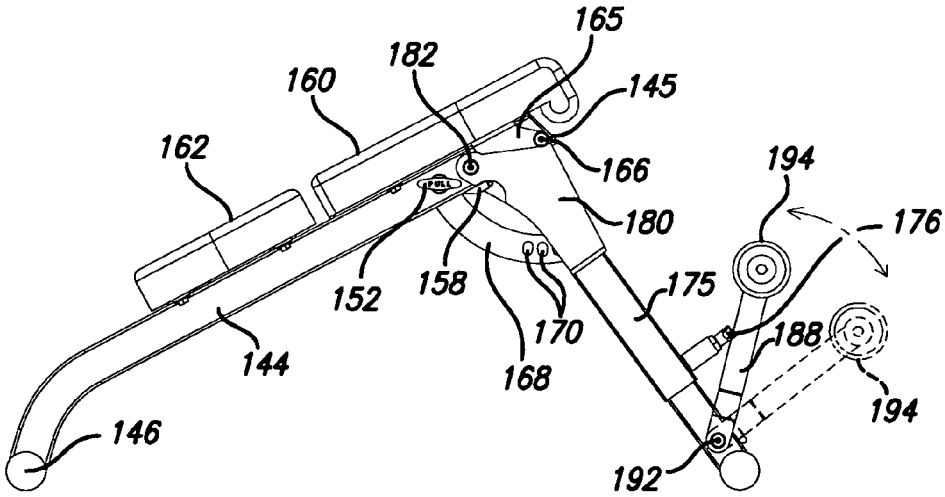
FIG. 40 is a side elevation view of the bench in the position of FIGS. 37 to 39.
Figure 43:
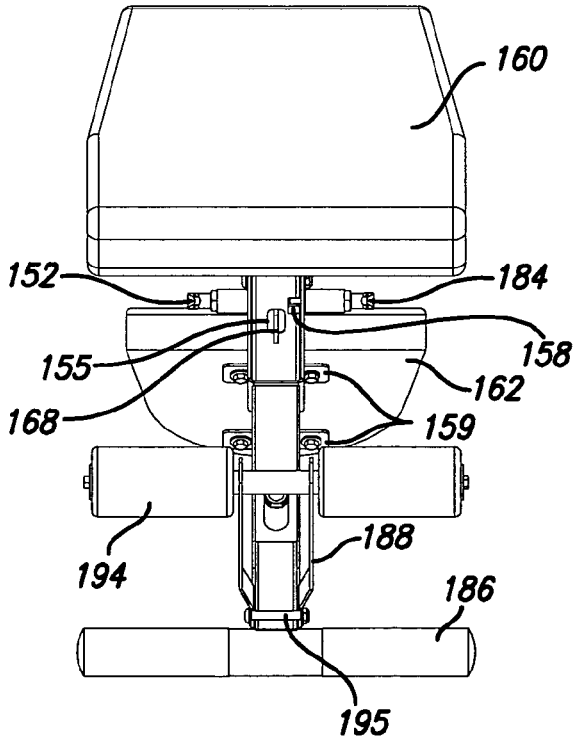
FIG. 43 is a front elevation view of the bench in the position of FIG. 42.
Figure 44:
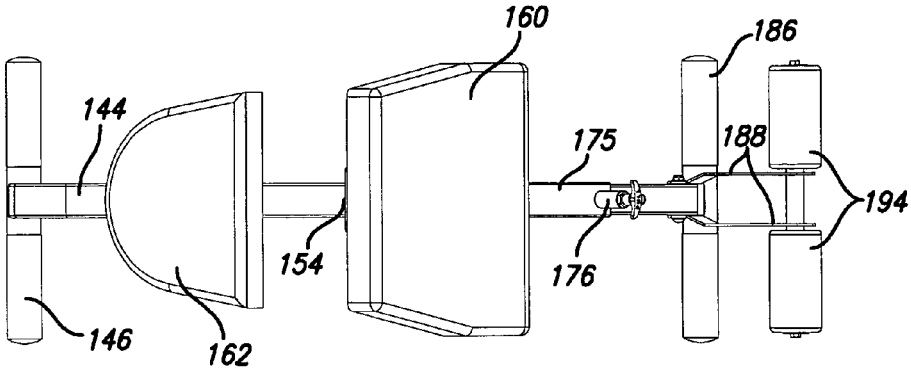
FIG. 44 is a top plan view of the bench in the position of FIG. 42.

Aligned pivot holes 149 and a pinning hole 151 are located in the side wall 150 of the straight section of the main tube 144, as best illustrated in FIG. 55, with the pivot hole positioned between the pinning hole and transverse mounting tube 148. A pull pin or spring-loaded plunger 152 is mounted to one side wall for extension through one of the side wall pinning holes, as illustrated in FIG. 51. Aligned elongated openings or slots 154,155 are located in the top and bottom walls 156,157 of the straight section of the main tube, as indicated in FIGS. 43, 51 and 55. The slots 154,155 are positioned in alignment with the pull pin 152, as seen in FIGS. 51 and 55. As best illustrated in FIGS. 40 and 55, a raised block or stop member 158 is attached to the bottom wall 157 of the main tube at a location between the slot 155 and the second end of the main tube. A pair of upholstery mounting-plates 159 are attached to the top wall of the first section between the slot 154 and the curved section of the main tube.

Figure 52:
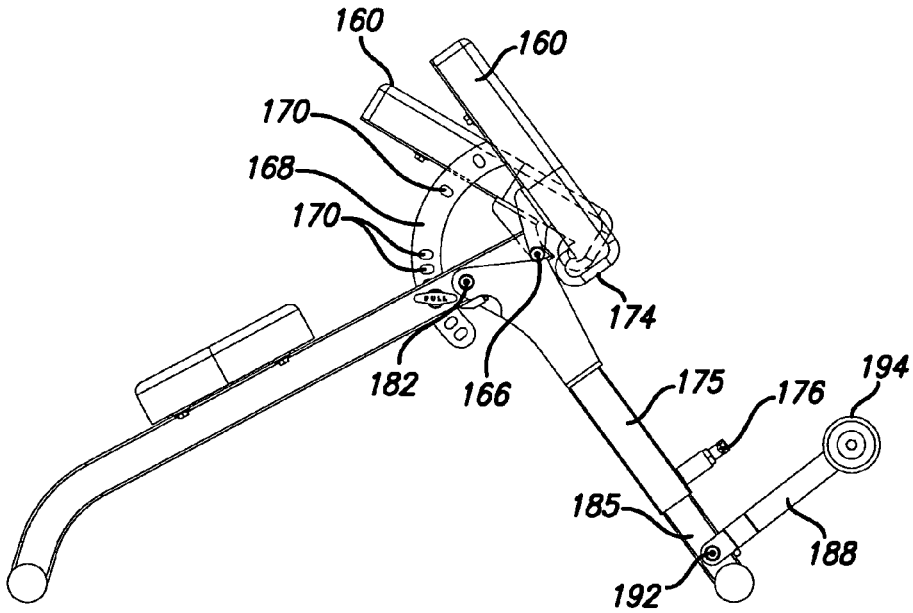
FIG. 52 is a side elevation view of the exercise bench illustrating different adjusted positions of the front pad in the second exercise position for performing lower back exercises.

As noted above, the bench has a split-seat system comprising a pivoting first seat pad 160 and a fixed second seat pad 162. The first seat pad 160 is mounted on a seat bracket 164 with downward projecting ears 165 at its forward end. Attachment holes are located approximate the end of each ear 165 for pivotal attachment to the mounting tube 148 via pivot pin 166. A curved adjuster plate 168 with multiple adjustment holes 170 is welded to underside of the bracket 164, and projects downwardly through the aligned slots 154,155 in the upper and lower faces 156,157 of the main tube 144, as best illustrated in FIGS. 51 and 52. The pull pin 152 has a projecting plunger 172 (FIG. 55) which will extend through a selected aligned hole 170 in the adjuster plate 168 when released. The first seat pad 160 has tapered sides and a rounded front edge 174 which provides support behind the user's knee when they are seated and performing abdominal crunch exercises. The second, fixed seat pad 162 is a smaller tapered pad that is fixedly mounted to the upholstery mounting plates 159 located atop the main tube.

Figure 55A:
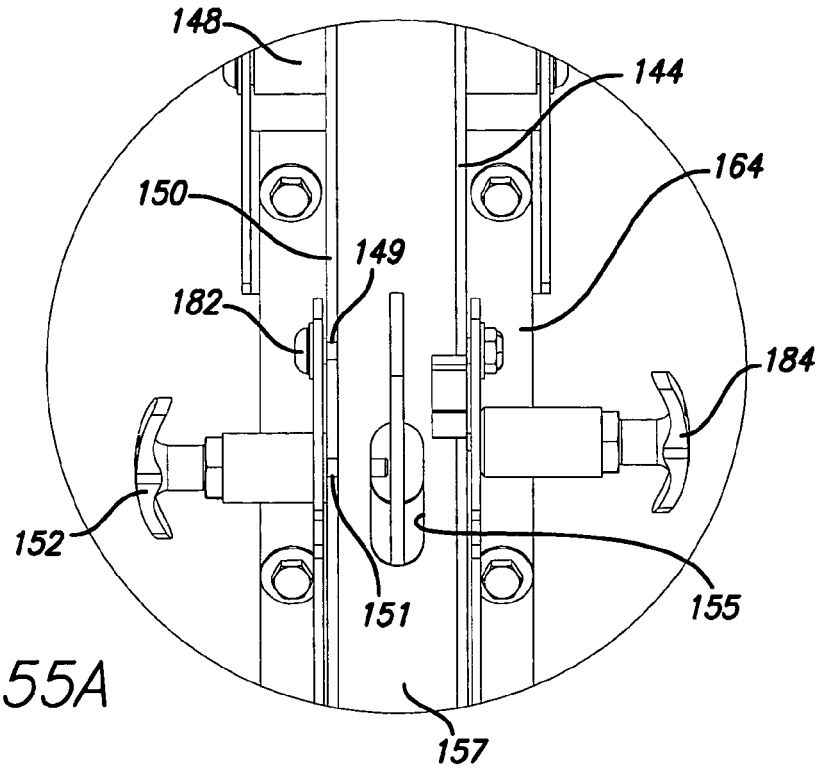
FIG. 55A is a bottom plan view of part of the underside of the bench with the front support leg in the folded position.
Figure 55B:
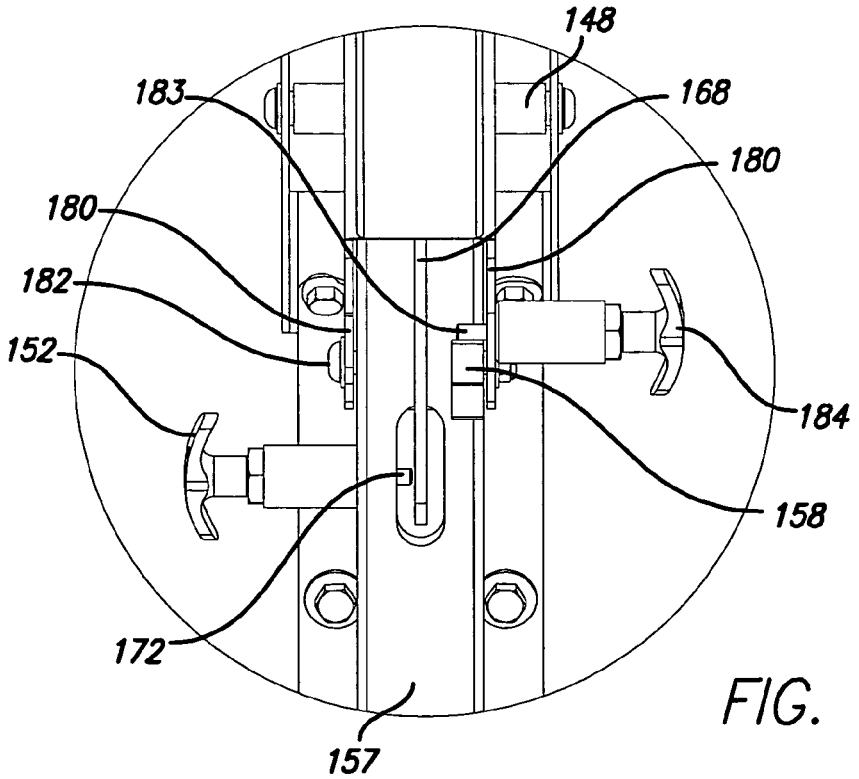
FIG. 55B is a bottom plan view similar to FIG. 55A but illustrating the front support leg in the exercise position.
Figure 56:
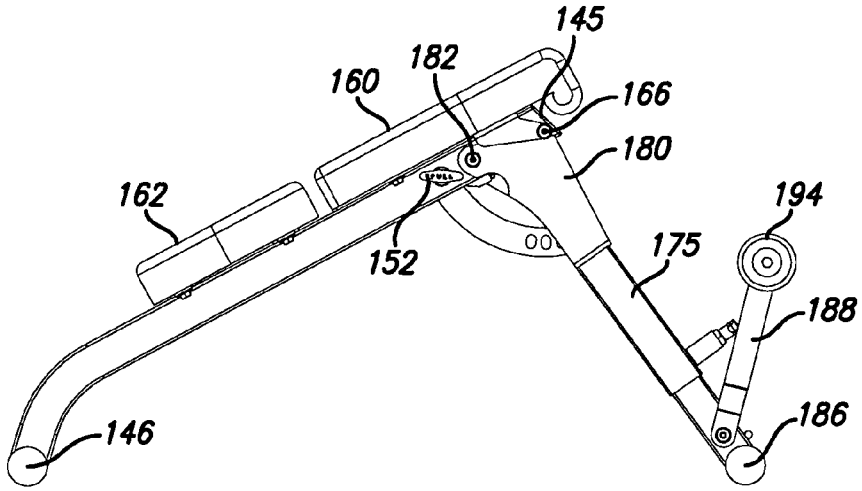
FIG. 56 is a side elevation view of the bench of the third embodiment in the exercise position for performing abdominal exercises, with the adjustable seat assembly in its lowest position.

The folding front leg assembly has a tubular front support leg 175 with an open lower end and a second end. A pull pin 176 is attached to the front wall of the leg approximate its open lower end. A generally "U" shaped bracket 178 is attached by its web to the second end of the support leg. The opposite legs 180 of bracket 178 extend upwardly and rearwardly to engage over opposite sides of the main frame tube 144, and have mounting holes (not visible in the drawings) located near their outermost edges which are aligned with the pivot holes 149 in the side walls of tube 144. The legs are pivotally secured to the main tube via pivot pin 182 which extends through the aligned mounting holes and pivot holes. One leg 180 has a pull pin 184 mounted to it at a location between the mounting hole and the bracket's connection to the support leg, as best illustrated in FIGS. 53, 53A, 55A and 55B. When the main support frame and folding front assembly are joined, the pull pin 184 acts to lock the folding front leg assembly in either the deployed exercise position or the folded position. As illustrated in FIG. 55A, the pull pin plunger 183 engages a second pinning hole 187 (visible in FIG. 53A) on the main support frame in the folded position. The plunger 183 is extended to wedge against the raised block 158 and the bottom wall of the main tube in the exercise position, as illustrated in FIGS. 53A and 55B. This way the front support leg assembly can be locked in either position. As best illustrated in FIGS. 50 and 51, the other leg 180 of the bracket 178 has a notch 189 in its rear edge for engaging around the pull pin 152 when the bench is in the folded position.

Figure 37:
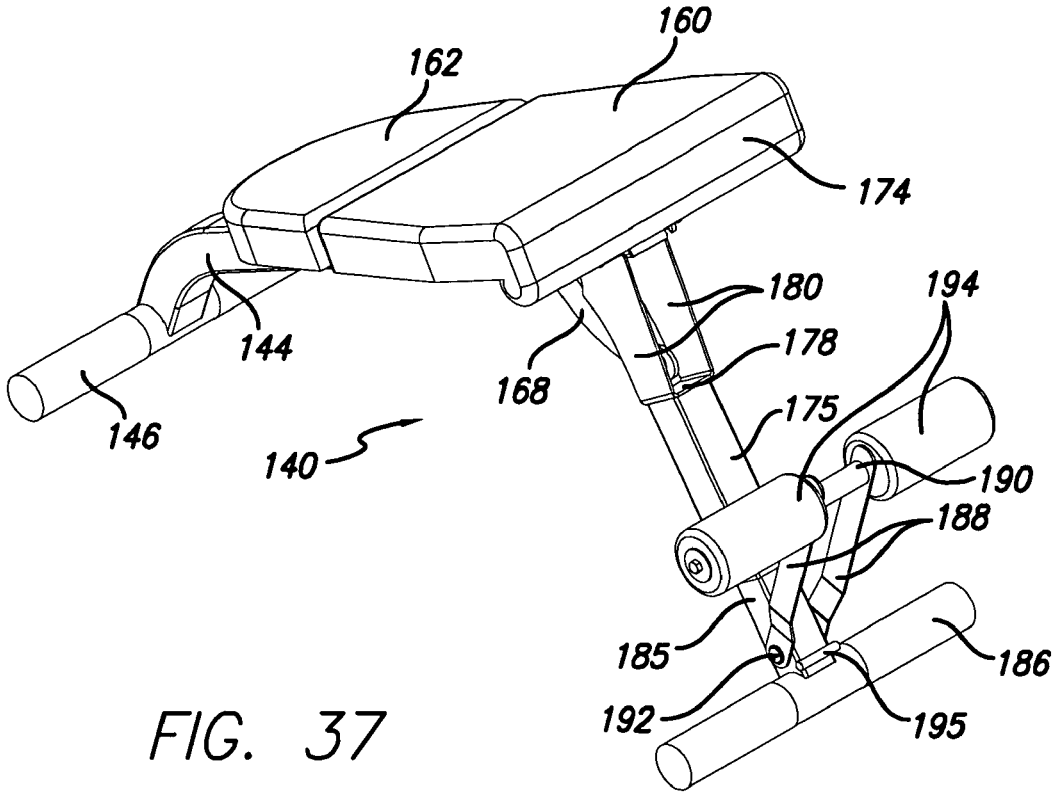
FIG. 37 is a perspective view of an exercise bench according to a third embodiment of the invention in a first exercise position for performing abdominal crunch exercises.
Figure 38:
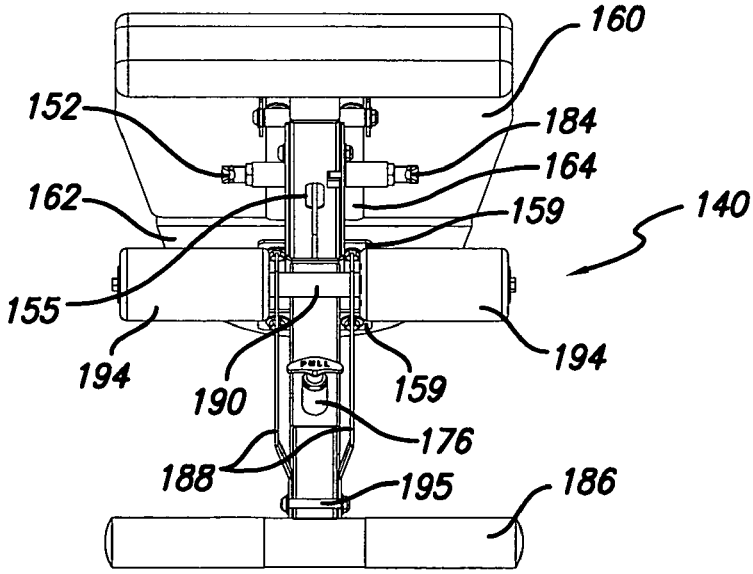
FIG. 38 is a front elevational view of the bench in the position of FIG. 37.
Figure 39:
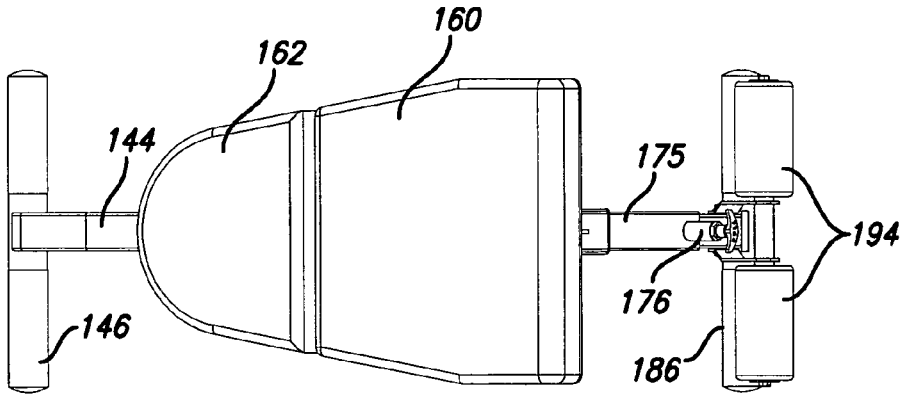
FIG. 39 is a top plan view of the bench of FIGS. 37 and 38.

A generally "T" shaped adjuster tube 185 with multiple adjustment openings is inserted into the open first end of the front support leg for telescopic adjustment with the support leg. The cross bar 186 at the lower end of tube 185 is for engagement with the floor. The pull pin 176 extends through the front wall of the support leg or tube 175 and into an aligned adjustment opening in tube 185 to lock the tube 185 at a selected extension relative to the tube 175. A generally "T" shaped foot stabilizer is pivotally connected to the adjuster tube 185. The stabilizer consists of two, spaced plates 188 with a mounting hole located towards the first end of each plate, and a user engaging cross bar 190 transversely connected at the second end of each plate. The plates are spaced apart to allow pivotal mounting to the side walls of the adjuster tube via a pivot pin 192 extending through the mounting holes at the first ends of the plates and corresponding pivot holes in the side walls of adjuster tube 185. Roller pads 194 are mounted to the ends of the user engaging cross bar for added comfort and to create a larger contact surface. A stop pin 195 is transversely attached to the front wall of the adjuster tube, between the mounting holes and the floor engaging cross bar, so that the ends of the pin protrude past the side walls of the adjuster tube, as best illustrated in FIG. 37. Once attached, the foot stabilizer's pivotal connection to the adjuster tube is limited in one direction by contact of plates 188 with the transverse pin 195 and in the other direction by contact of cross bar 190 with the front face of the front leg support tube 175 (see FIG. 38).

The bench 140 will now be described in the position illustrated in FIGS. 37 to 41 and 56 for use in performing abdominal crunch exercises. In this position, as noted above, the plunger 183 of pull pin 184 will be stopped against the stop block 158 on the underside of the main frame tube 144. In these drawings, the pivoting seat pad 160 is in its lowermost position seated on top of the main frame tube 144 with the plunger of pull pin 152 extending through an aligned opening in curved adjuster plate 168 to lock the seat pad in position. In the down position, the two seat pads 160 and 162 provide support for a seated exerciser performing abdominal exercises. The adjuster tube 185 which is telescopically engaged in the lower end of the front support leg or tube 175 may also be in a retracted position, with pull pin 176 engaging through an adjustment hole in the front face of tube 185 to lock it in position, but may be adjusted to vary exercise difficulty or for user's with different leg lengths, as discussed below.

Figure 41:
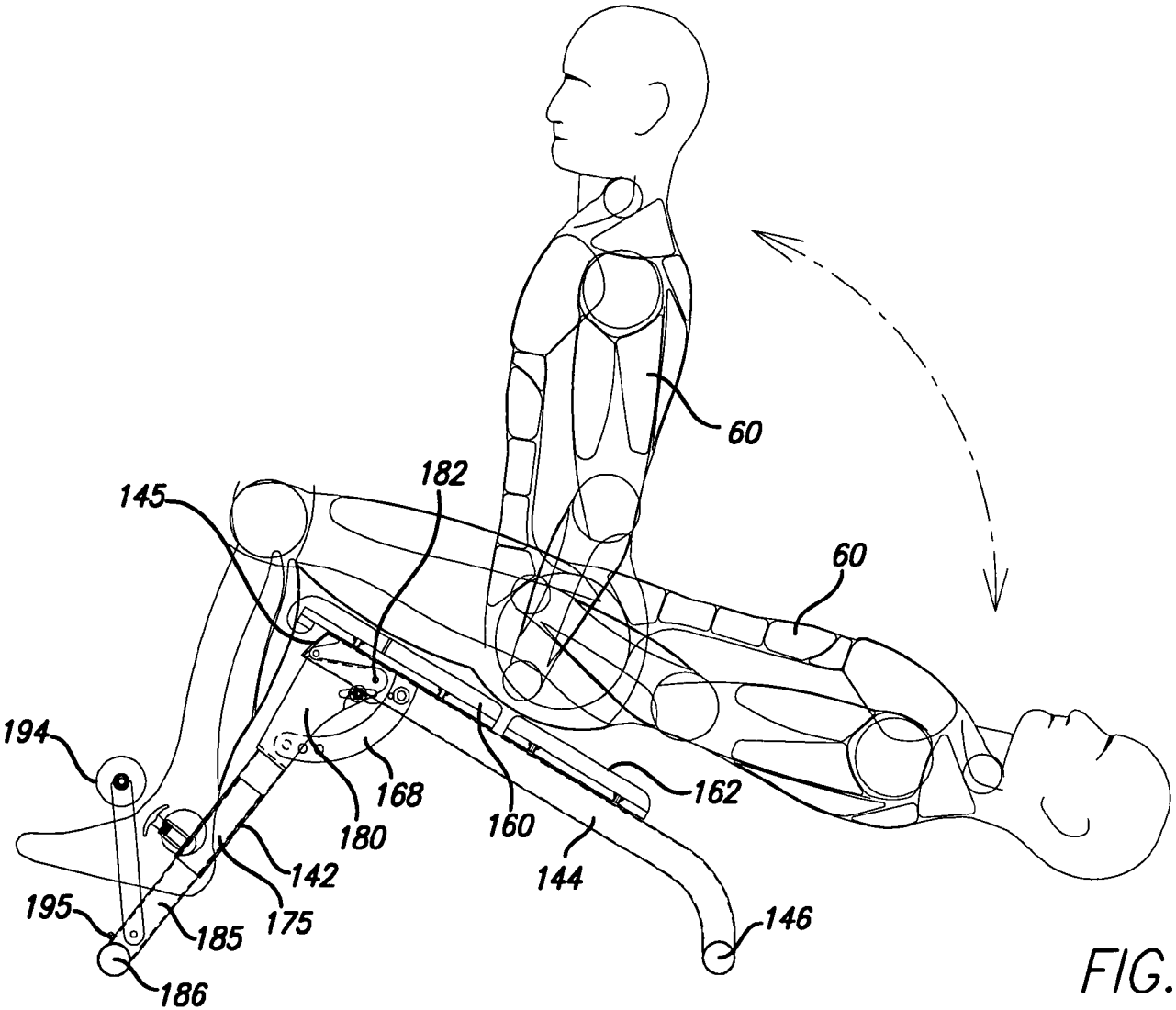
FIG. 41 is a side elevation view similar to FIG. 40 illustrating a user performing a seated abdominal exercise.
Figure 42:
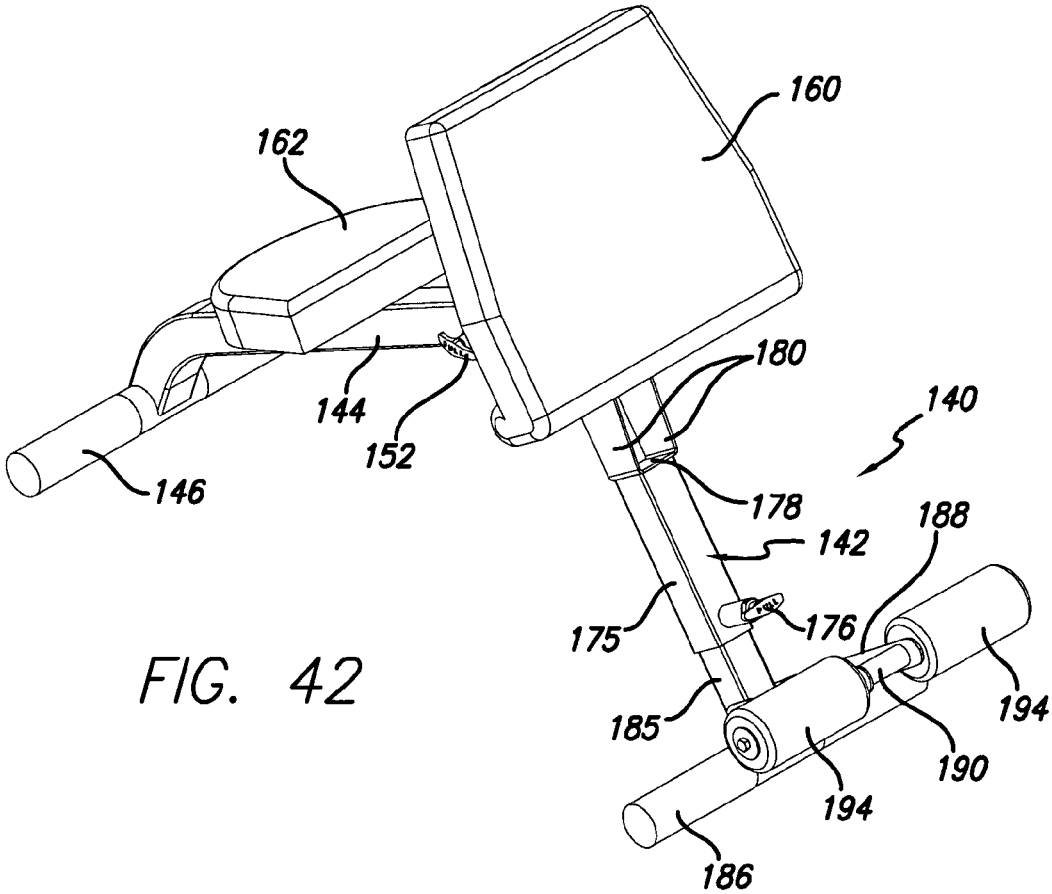
FIG. 42 is a perspective view of the third embodiment of the exercise bench in a second exercise position for performing back hyper-extension exercises.

FIG. 41 shows a user 60 performing a seated abdominal exercise. In FIG. 41, hidden lines have been revealed to better show the various components. The user first sits upright on the front pad 160, facing forwards, and hooks their feet under the foot stabilizer pads 194. FIG. 40 illustrates the self-aligning capabilities of the pivoting foot stabilizer. They then lean their torso rearward, pivoting at the waist until their abdominal muscles are under tension, as illustrated in the reclined user position of FIG. 41. The user then returns to the upright position. The upright position in FIG. 41 represents both the start and finish of the exercise, while the reclined position shows the intermediate position when the abdominal muscles are under tension.

Figure 57:
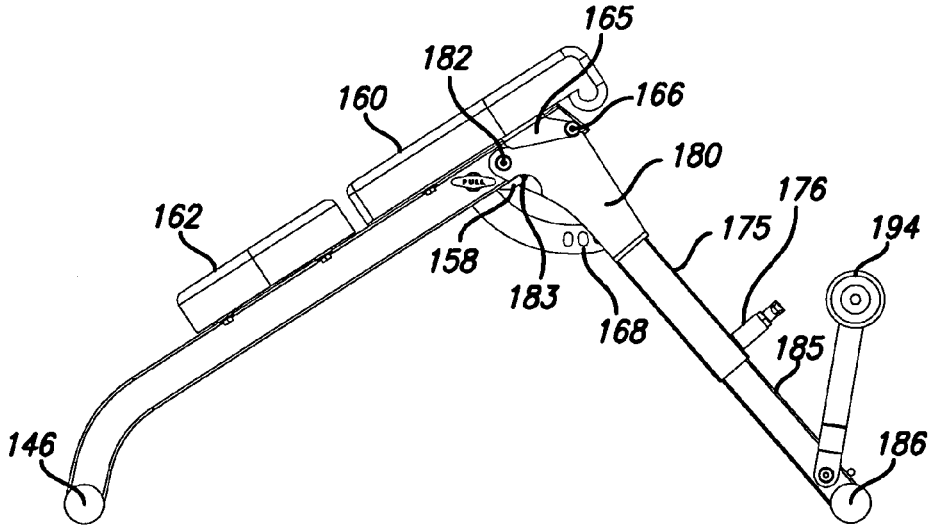
FIG. 57 is a side elevation view similar to FIG. 56 illustrating the adjustable seat assembly in a raised position.
Figure 58A:
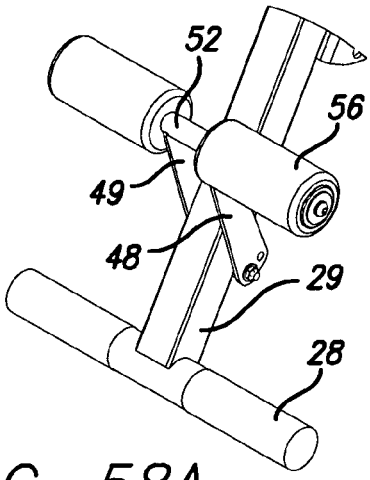
FIG. 58A is a front perspective view of the self-aligning foot stabilizer of the first embodiment of the exercise bench.
Figure 58B:
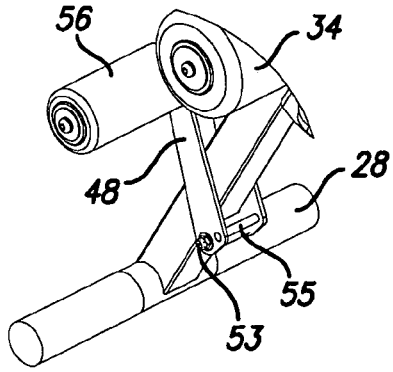
FIG. 58B is a rear perspective view of the foot stabilizer of FIG. 58A.
Figure 59A:
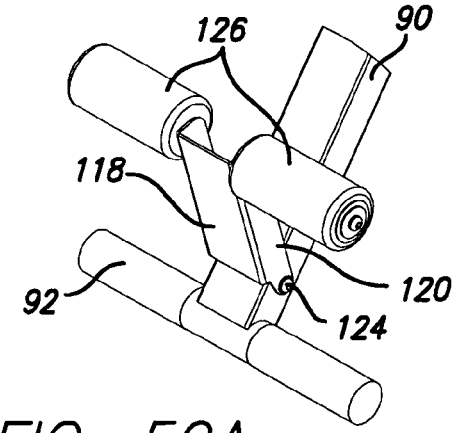
FIG. 59A is a front perspective view of the self-aligning foot stabilizer of the second embodiment of the exercise bench.
Figure 59B:
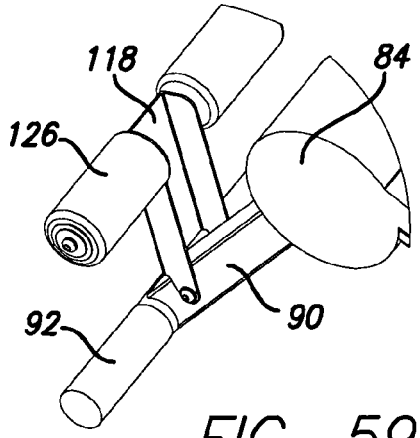
FIG. 59B is a side perspective view of the foot stabilizer of FIG. 59A.
Figure 60A:
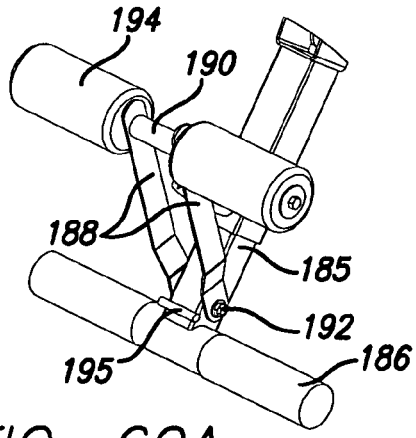
FIG. 60A is a front perspective view of the self-aligning foot stabilizer of the third embodiment of the exercise bench.
Figure 60B:
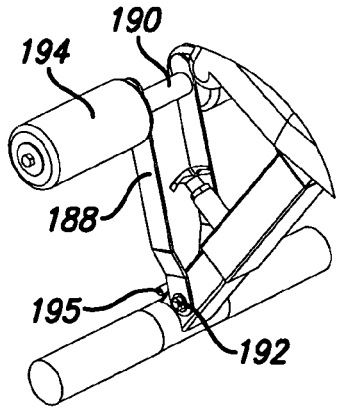
FIG. 60B is a rear perspective view of the foot stabilizer of FIG. 60A.

Because the seat pads 160,162 are inclined, the user must use their stomach muscles to pull their body up hill, against the force of gravity. The greater the angle of the seat pad, or the greater the elevation between the user's knees and hips, the greater the effort that will be required to return to the upright position. The effort required for performing an abdominal crunch exercise in this case may be adjusted by increasing the length of the support leg assembly 142, i.e. by extending the length of adjuster tube 185 extending out of the support leg or tube 175, as indicated in FIG. 57. By slightly raising the support leg, the forward end of the seat assembly is raised to change the user's seated angle from 28 to 33 degrees, and simultaneously increases the amount the user's knees are raised above their hips. The height at the top of the forward end 174 of the seat is 22.75 inches in FIG. 56 and 25 inches in the raised position of FIG. 57. The steeper the seated angle of the user, the greater the gravitational influence of their body weight on the exercise. This adjustment is also used to vary the height of the thigh support when performing back exercises.

Figure 45:
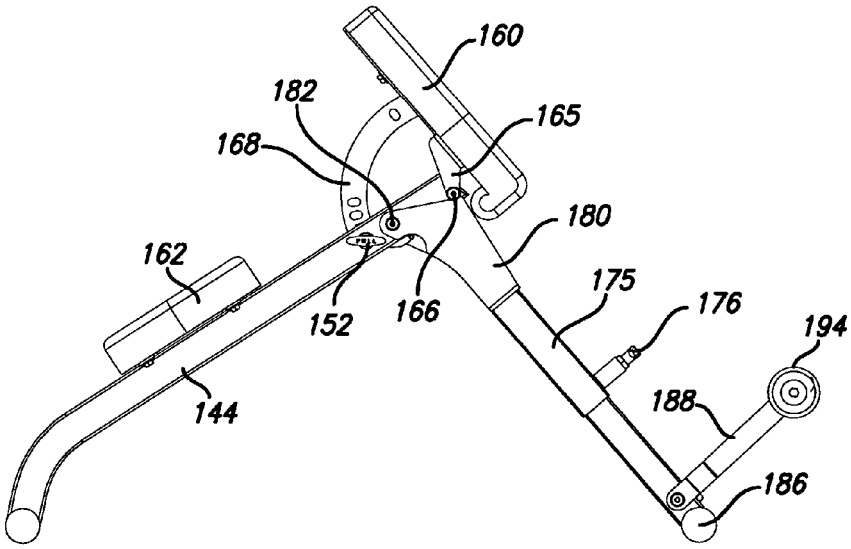
FIG. 45 is a side elevation view of the bench in the position of FIG. 42.

In FIGS. 42 to 46, the position of the bench has been modified to allow a back hyper-extension exercise to be performed. In this position, the front seat pad 160 is raised so that it faces generally forwardly to act as a thigh support for a user. This is done by releasing pull pin 152 from the adjuster plate 168, and then rotating the rear end of the seat pad 160 upwardly so that the seat pad pivots about pivot pin 166 into the raised position, as best illustrated in FIG. 45. FIGS. 51 and 52 also illustrate the pad 160 being pivoted into a raised position. FIG. 51 illustrates how the adjustable seat bracket with its curved adjuster plate 168 passes through the slot in the main tube as the first seat pad is adjusted from one exercise position to the next. The angle of seat pad 160 in the upright or raised position can be varied to a less steep or steeper angle to increase or decrease the level of exercise difficulty. FIG. 52 highlights the multiple angular positions available for performing Back Hyper-Extension exercises. By adjusting the angle of the user engaging thigh support 160, as indicated in FIG. 52, the gravitational effect of the user's body weight is adjusted. The steeper or closer the pad is to vertical the less impact gravity has on the user and the easier the exercise. When the seat pad 160 is in the desired orientation, the pull pin 152 is released and engages an aligned opening 170 in plate 168 to lock the seat pad in position.

Figure 46:
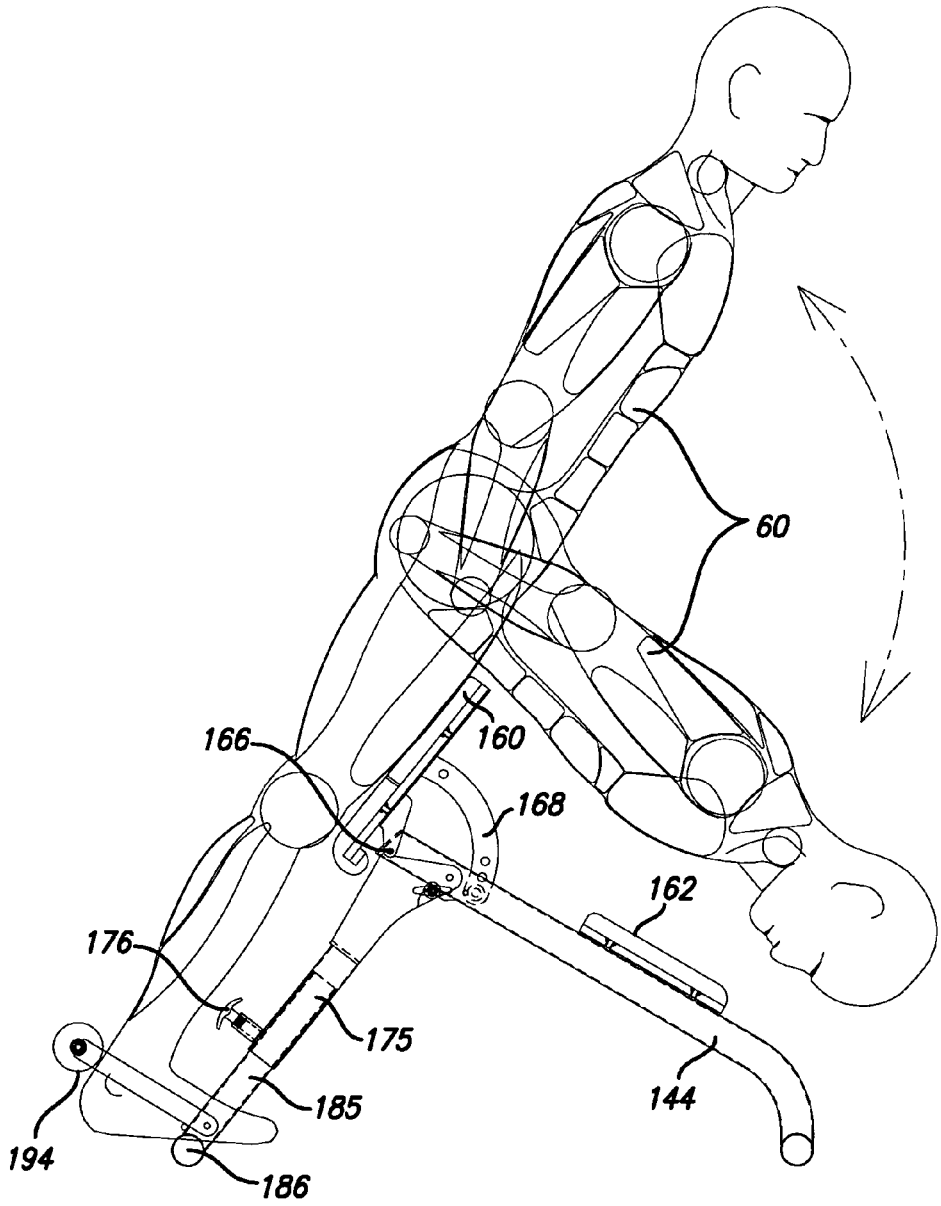
FIG. 46 is a side elevation view similar to FIG. 45 illustrating a user performing a lower back exercise.
Figure 47:
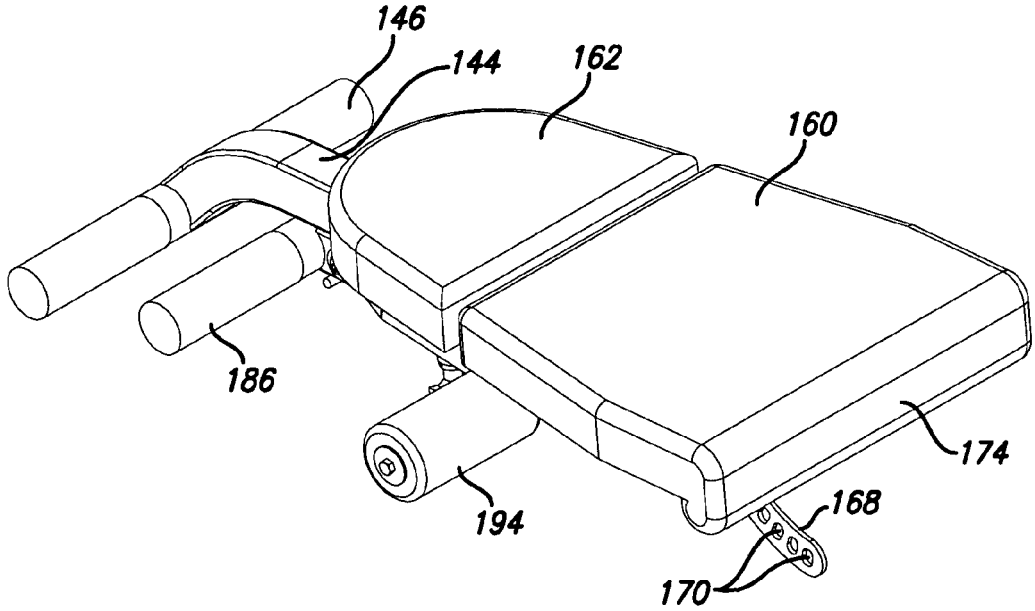
FIG. 47 is a perspective view of the bench of FIGS. 37 to 46 in a folded or storage position.
Figure 48:
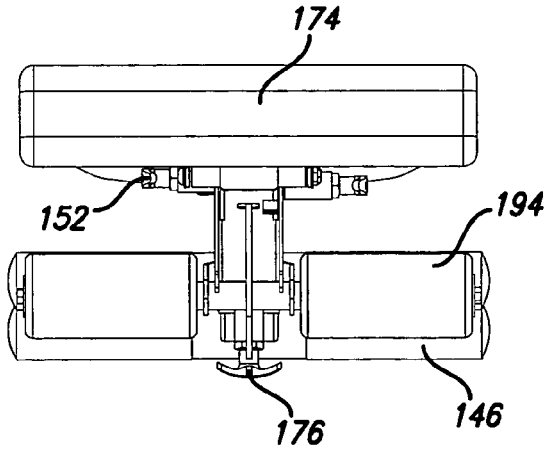
FIG. 48 is a front elevation view of the bench in the folded position of FIG. 47.
Figure 49:
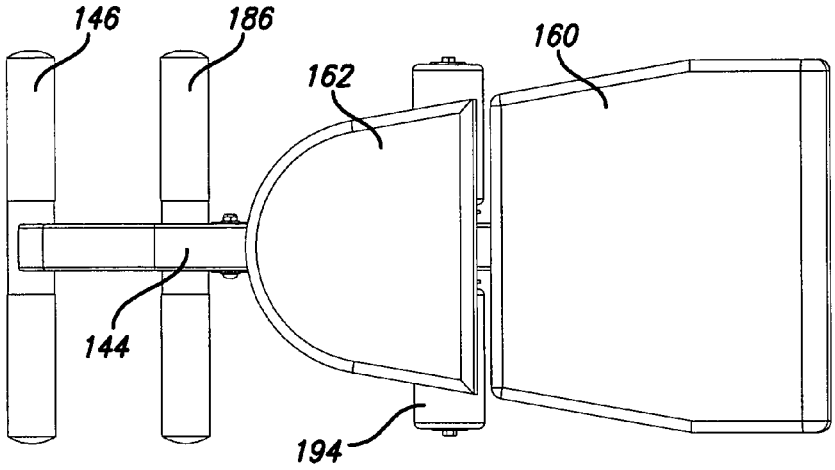
FIG. 49 is a top plan view of the bench in the folded position of FIG. 47.

FIG. 46 shows a user 60 performing a low back exercise. Before performing this exercise, the user can adjust the height of the thigh support or raised pad 160 to an appropriate position for engaging the front of their upper thigh as indicated in FIG. 46. This is done by adjusting the overall length of the folding front leg assembly by extending adjuster tube 185 until the pad 160 is at the desired height, and then releasing pull pin 176 to lock the tube in the adjusted position. The upright position of the user in FIG. 46 represents both the start and finish of the exercise, while the bent position shows the intermediate position. The user 60 stands on the foot rest 186 with the foot stabilizer pads 194 engaging behind their ankles and over their heels, and leans against the pad 160. Once the user is locked in place in this way, they can bend forward at the waist until their low back muscles are under tension, as indicated by the forwardly bent position in FIG. 46, and then return to the starting position. The relative positions of the foot rest 186 and thigh engaging pad 160 are such that the user is placed in a forwardly inclined starting position, putting their torso under the influence of gravity, and this force increases as soon as they start the exercise, forcing their back muscles to resist the force of gravity.

FIGS. 47 to 50 illustrate the bench 140 in a folded or storage position, while FIGS. 53 and 54 illustrate the folding front support assembly in the process of being folded between the exercise and storage position or vice versa. With the front seat pad 160 returned to the lowermost position seated on top of main tube 144, the front support leg 175 is rotated rearwardly about pivot 182. The pull pin 184 is pulled outwardly so that the plunger can clear the side wall of the tube 144 and then enter the opening 187 to lock the folding front assembly in the folded position. At the same time, the notch 189 in the opposite leg 180 (see FIGS. 50, 54 and 54A) will fit around the pad adjusting pull pin 152.

The folded position of FIGS. 47 to 50 allows the bench to be stored out of the way, in a closet or under a bed when not in use and allows the product to be boxed fully assembled for easier shipping. In this position, the front support leg fits up against the underside of the straight section of the main tube, ending before the tube bends towards its first end. At the same time, the user engaging roller pads 194 on the foot stabilizer are spaced wider than the front support leg to allow them to fold up past the leg's front wall. This provides a more compact folded profile and keeps the pads protected within curved frame work of the main support frame.

FIGS. 58 to 61 show several alternative embodiments of the self-aligning foot stabilizer as described above in connection with the embodiments of the bench illustrated in FIGS. 1 to 57. It will be understood that the stabilizers of FIGS. 58 to 61 are interchangeable and any one of these stabilizers may be used in any of the above embodiments. In FIGS. 58A and 58B, the stabilizer pivots off the rear wall of the front support leg and utilizes a bolt 55 contacting the rear wall of the support leg 29 as stop means to limit the forward motion of the stabilizer. Rearward motion of the foot stabilizer is limited by the center section 52 of the cross bar which connects to the second end of the spaced plates 48, 49. In FIGS. 59A and 59B, the stabilizer pivots on the side walls of the support leg and uses the end of the web 118 and the inner surface of the stabilizer channel as stop means to limit the stabilizer's forward and rearward motion. In FIGS. 60A and 60B, the stabilizer pivots on the side walls of the support leg, similar to the design in FIGS. 59A and 59B, but has spaced plates 188 instead of a U-shaped channel. The forward edges of the twin plates contact a pin 195 transversely attached to the front wall of the adjuster tube to limit the forward motion of the foot stabilizer. The rearward motion is limited by the center section 190 of the cross bar, similar to the arrangement in FIGS. 58A and 58B.

Figure 61A:
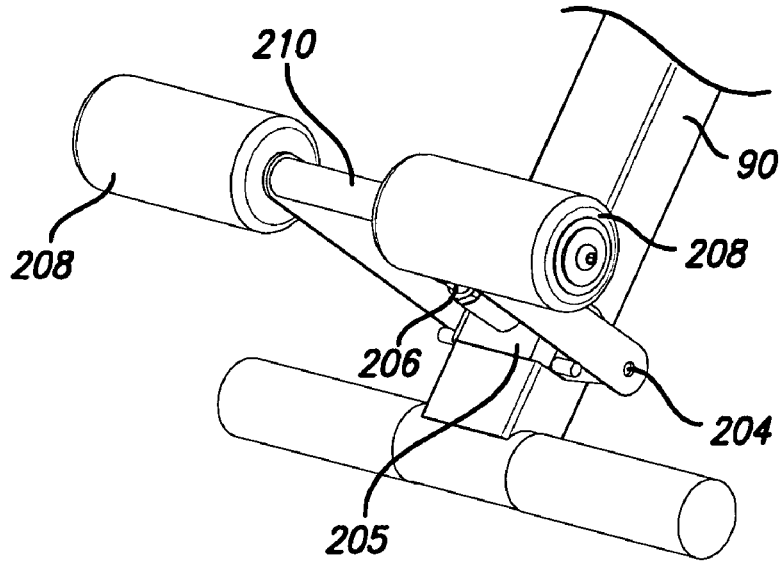
FIG. 61A is a front perspective view of an alternative self-aligning foot stabilizer.
Figure 61B:
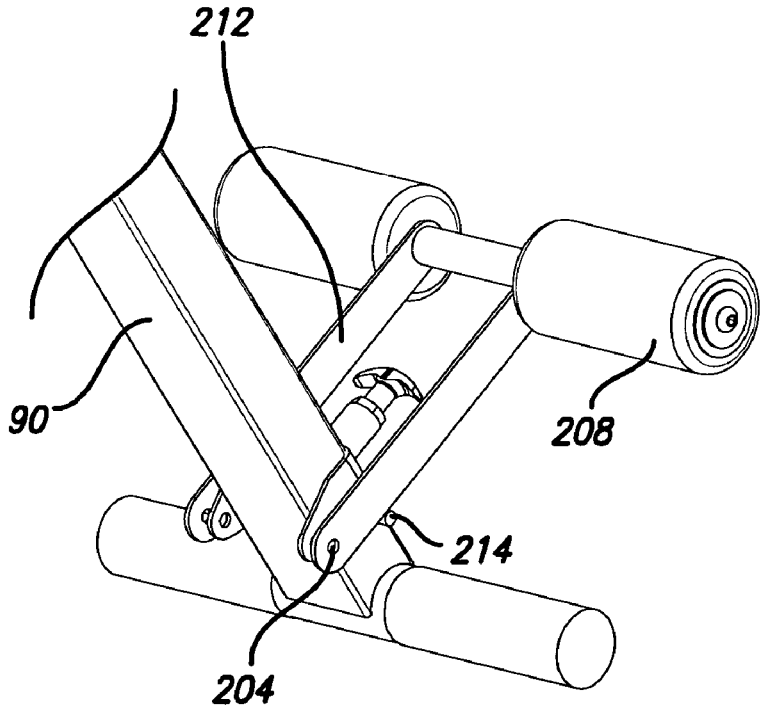
FIG. 61B is a rear perspective view of the foot stabilizer of FIG. 61A.

In FIGS. 61A and 61B, the foot stabilizer is pivotally mounted on a bracket 205 which is adjustably secured to a front support leg 90 of an exercise bench as described above in connection with FIG. 36A. A pull pin 206 extends through an opening in a front wall of the bracket 205 and a selected opening in the front wall of the support leg 90. This allows the foot stabilizer to be adjusted along the length of the front support leg to accommodate users having different leg lengths. The foot stabilizer itself is similar to the embodiment of FIG. 58, and has a pair of pads 208 mounted on opposite ends of support rod 210. A pair of spaced pivot mounting plates 212 extend on opposite sides of the front support leg and are secured to support rod 210 at one end, and pivotally mounted on the rear end of mounting bracket 205 at their opposite ends via pivot pins 204. Stop pin 214 on the opposite sides of bracket 205 restricts downward pivoting movement of the foot stabilizer and hold the stabilizer in an exercise-ready position.

In all four versions of the foot stabilizer, the foot stabilizer pads self-align to the user and provide support/positioning for the user's feet during the performance of both abdominal and low back exercises. The ability of the foot or ankle engaging pads to swivel allows the foot stabilizer to fold up tight against the front of the support leg when the bench is in the storage position as well as to self-align to the user. Because of the stop means used to limit the pivotal range of motion of the foot stabilizer pads, the stabilizers will never pivot out of their exercise ready position and are always easily accessible for either type of exercise. It should also be noted that other components or features in the above embodiments of the exercise bench, such as locking pull pins, pinning hole vs. slots, stop means, exercise angle adjustment means, pivoting vs. sliding pad adjusters, or single vs. dual seat pads, may be interchanged between the embodiments and not alter the scope of the invention.

The folding exercise bench of this invention is designed to allow the user to perform both abdominal and lower back exercises, and is easy to switch between the positions for the different types of exercise. The bench is readily adjustable for various size exercisers to perform both types of exercise effectively, and is also adjustable for different levels of exercise difficulty. While resistance for both exercises is supplied by the user's body weight, this could be augmented by hand held weights, elastic bands, or other forms of resistance known in the art, if desired. The bench also has the ability to fold up and lock into a relatively flat, compact storage position without having to first remove any components from the bench. The storage position allows the bench to be readily stored out of the way, in a closet or under a bed, when not in use. It also allows the product to be boxed when fully assembled for easier shipping, and requiring no assembly by a purchaser. In the folded position, the entire front leg assembly is folded up against or close to a straight portion of the main frame, and tucked up within a curved end portion of the main frame.

The user engaging foot stabilizer in each of the above embodiments is pivoted to the front support leg assembly at a location which does not adjust with the seat. This means that the distance between the seat pad and the foot stabilizer can be varied to accommodate users of different heights with different leg lengths. At least a portion of the foot engaging pads of the foot stabilizer can swing past the front wall or edge of the front support leg in the folded condition to allow the foot stabilizer to fold up tight against the front support leg for more compact storage and also to protect the pads against damage when stored. The end stops which limit pivotal movement of the foot stabilizer ensure that it is always readily accessible to the user in an exercise ready position. The foot stabilizer is also designed to self-align to the user during each exercise.

Although some exemplary embodiments of the invention have been described above by way of example only, it will be understood by those skilled in the field that modifications may be made to the disclosed embodiments without departing from the scope of the invention.

I claim:

1. An exercise bench, comprising:

a main frame having a first end which engages the ground, an opposite, second end, and a support portion between the first and second ends, the main frame engaging the ground only at the first end and the support portion and second end raised above the ground in an exercise position;

a front leg secured to the main frame and having a foot portion which engages the ground in the exercise position to hold the second end of the main frame in the raised position;

a support pad which supports part of the user's body mounted on one of said front leg and said main frame;

the front leg being adjustable in length to adjust the height of the support pad;

a user engaging foot stabilizer; and a pivot mount pivotally associating the foot stabilizer with the front leg whereby adjustment of the length of the front leg adjusts the distance between the foot stabilizer pivot mount and the support pad.

2. The exercise bench as claimed in claim 1, wherein the foot stabilizer is adjustably mounted on the front leg so as to accommodate users having different length legs.

3. The exercise bench as claimed in claim 1, further comprising a carriage member slidably associated with the main frame, the support pad having a rear end pivotally secured to the carriage member and a forward end secured to an upper end of the front leg, whereby adjustment of the length of the front leg will cause the forward end of the support pad to pivot upwardly and the rear end to slide forwardly along the main frame.

4. The exercise bench as claimed in claim 3, wherein the support pad comprises a seat pad for supporting a seated user in a first abdominal exercise position, and the forward end of the support pad is enlarged and comprises means for engaging behind the knees of the seated user in a first, abdominal exercise position and means for engaging the thighs of a standing user in a second, lower back exercise position.

5. The exercise bench as claimed in claim 1, wherein the front leg has first and second telescopically engaged portions for adjusting the length of the front leg, and a locking device for releasably locking the portions in a selected adjusted position, the first portion having a lower end comprising said foot portion, and the foot stabilizer being associated with said first portion.

6. The exercise bench as claimed in claim 5, wherein the first portion of the front leg is pivotally secured at or adjacent the second end of the main frame, the front leg being foldable between a deployed, exercise position supporting the second end of the main frame in the raised position and a storage position folded against the main frame.

7. The exercise bench as claimed in claim 6, wherein the second portion of the front leg has an upper end and the support pad is secured to the upper end of said second portion.

8. The exercise bench as claimed in claim 7, further comprising a seat pad having a rear end pivotally and slidably associated with the main frame and an enlarged forward end comprising said support pad.

9. An exercise bench, comprising:

a main frame having a first end which engages the ground and a second end raised above the ground in an exercise position;

a front leg secured to the main frame and having a foot portion which engages the ground in the exercise position to hold the second end of the main frame in the raised position;

a support pad which supports part of the user's body mounted on one of said front leg and said main frame;

the front leg being adjustable in length to adjust the height of the support pad;

a user engaging foot stabilizer;

a pivot mount pivotally associating the foot stabilizer with the front leg whereby adjustment of the length of the front leg adjusts the distance between the foot stabilizer pivot mount and the support pad;

the support pad being adjustable in height between positions for engaging behind a user's knees when seated on the main frame in a first, forwardly facing abdominal exercise position and different height positions for engaging in front of a user's thighs when standing in a second, rearwardly facing lower back exercise position, the foot stabilizer comprising means for engaging over a user's feet in the first exercise position and behind a user's ankles in the second exercise position.

10. The bench as claimed in claim 9, wherein the support pad is mounted on an upper end of said front leg, whereby adjustment of the length of said front leg adjusts the height of the support pad.

11. The bench as claimed in claim 9, wherein the support pad is mounted on the main frame, and the front leg has an upper end pivotally associated with the forward end of the main frame, whereby adjustment of the length of said front leg will adjust the height of the forward end of the main frame and thereby adjust the height of said support pad.

12. The bench as claimed in claim 9, further comprising a seat pad having a rear end pivotally associated with the main frame and a forward end comprising said support pad, the front leg having an upper end associated with the forward end of said seat pad, whereby adjustment of the length of said front leg will pivot the forward end of said seat pad upwardly, thereby adjusting the height of said support pad.

13. The exercise bench as claimed in claim 9, wherein the foot portion comprises a cross bar forming a foot support for a user's feet when standing in the second exercise position.

14. An exercise bench, comprising:

a main frame having a first end which engages the ground and a second end raised above the ground in an exercise position;

a front leg secured to the main frame and having a foot portion which engages the ground in the exercise position to hold the second end of the main frame in the raised position;

a support pad which supports part of the user's body mounted on one of said front leg and said main frame;

the front leg being adjustable in length to adjust the height of the support pad;

a user engaging foot stabilizer;

a pivot mount pivotally associating the foot stabilizer with the front leg whereby adjustment of the length of the front leg adjusts the distance between the foot stabilizer pivot mount and the support pad;and a stop member for limiting the range of motion of said foot stabilizer relative to its pivot mount.

15. The exercise bench as claimed in claim 14, wherein the foot stabilizer has a first end secured to said pivot mount and a second, foot engaging end, the stop member preventing downward movement of the foot stabilizer to a location where the foot engaging end is below the level of said pivot mount.

16. The exercise bench as claimed in claim 14, wherein the front leg has a front wall, and the foot stabilizer comprises a cross member extending transversely across the front wall of the frame, oppositely directed pads secured to opposite ends of the cross member, and a pivot bracket assembly extending rearwardly from the cross member and pivotally securing the cross member on said pivot mount, the cross member comprising means for restricting pivoting motion of the foot stabilizer in a first direction.

17. The exercise bench as claimed in claim 16, wherein the front leg has a rear wall, the pivot mount is located on the rear wall, and the pivot bracket assembly comprises a pair of plates extending on opposite sides of said front leg to engage said pivot mount, the stop member comprising a stop pin secured between said plates at a location rear of said rear wall, whereby the stop pin engages the rear wall of the front leg to restrict pivoting motion of the foot stabilizer in a second direction.

18. The exercise bench as claimed in claim 16, wherein the pivot bracket assembly comprises a pair of plates extending from said pivot mount on opposite sides of said front leg up to said cross member, and the stop member comprises a slop pin secured across the front face of said front leg below said pivot mount for engaging the plates to restrict pivoting motion of the foot stabilizer in a second direction.

19. The exercise bench as claimed in claim 14, wherein the foot stabilizer comprises a channel member having a first end engaging said pivot mount and a second end, and oppositely directed foot engaging pads secured to the second end of the channel member, the channel member having an inner face facing the front leg, the first end of the channel member comprising a first stop member for engaging the front wall of the front leg to restrict pivoting motion of the foot stabilizer in a first direction and the inner face of the channel member comprising a second stop member for engaging the front wall of the front leg to restrict pivoting motion of the foot stabilizer in a second direction.

20. An exercise bench, comprising:

a main frame having a first end which engages the ground and a second end raised above the ground in an exercise position;

a front leg secured to the main frame and having a foot portion which engages the ground in the exercise position to hold the second end of the main frame in the raised position;

a support pad which supports part of the user's body mounted on one of said front leg and said main frame;

the front leg being adjustable in length to adjust the height of the support pad;

a user engaging foot stabilizer;

a pivot mount pivotally associating the foot stabilizer with the front leg whereby adjustment of the length of the front leg adjusts the distance between the foot stabilizer pivot mount and the support pad;and the front leg is pivotally associated with the second end of the main frame, the front leg being foldable between a deployed, exercise position supporting the second end of the main frame in the raised position and a storage position folded against the main frame.

21. The exercise bench as claimed in claim 20, wherein the foot stabilizer has a first end secured to the pivot mount and a second end, and a foot engaging portion at the second end of the stabilizer, the front leg having a front wall, and the foot stabilizer being pivotal into a folded, storage position when the front leg is in the storage position, at least part of the foot engaging portion extending past the front wall in the storage position, whereby the amount of said foot stabilizer protruding from said front wall in the storage position is reduced.

22. The exercise bench as claimed in claim 20, including a locking device for locking the front leg in the deployed and storage positions.

23. An exercise bench, comprising;

a main frame having a first end which engages the ground and a second end raised above the ground in an exercise position;

a front leg secured to the main frame and having a foot portion which engages the ground in the exercise position to hold the second end of the main frame in the raised position;

a support pad which supports part of the user's body mounted on one of said front leg and said main frame;

the front leg being adjustable in length to adjust the height of the support pad;

a user engaging foot stabilizer;

a pivot mount pivotally associating the foot stabilizer with the front leg whereby adjustment of the length of the front leg adjusts the distance between the foot stabilizer pivot mount and the support pad; and a seat pad mounted on the main frame, the seat pad being split into a front portion pivotally mounted on the frame and a rear, fixed portion.

24. The exercise bench as claimed in claim 23, wherein the front portion of the seat pad comprises said support pad and has a front end pivotally mounted adjacent the second end of the main frame for movement of the front portion between a lowered position aligned with the rear portion for providing a seat pad for performing abdominal exercises and a raised, forwardly facing position for engaging the thighs of a user when performing lower back exercises, the main frame further comprising a locking device for locking the front portion of the seat pad in the lowered and raised positions.

* * * * *